US012209379B2

(12) United States Patent
Reardon et al.

(10) Patent No.: US 12,209,379 B2
(45) Date of Patent: Jan. 28, 2025

(54) ANCHORED HOLE COVER

(71) Applicant: Clover Equipment, LLC, Anaheim, CA (US)

(72) Inventors: Mike Reardon, Yorba Linda, CA (US); Kevin Reardon, Anaheim Hills, CA (US)

(73) Assignee: Clover Equipment, LLC, Anaheim, CA (US)

( * ) Notice: Subject to any disclaimer, the term of this patent is extended or adjusted under 35 U.S.C. 154(b) by 229 days.

(21) Appl. No.: 17/807,818

(22) Filed: Jun. 20, 2022

(65) Prior Publication Data

US 2022/0412039 A1 Dec. 29, 2022

Related U.S. Application Data

(63) Continuation-in-part of application No. 17/357,820, filed on Jun. 24, 2021, now Pat. No. 11,365,524.

(51) Int. Cl.
*E02D 29/14* (2006.01)

(52) U.S. Cl.
CPC ..... *E02D 29/1427* (2013.01)

(58) Field of Classification Search
CPC .... E02D 29/1427; E02D 17/10; F16L 55/136; F16L 55/124; B23B 5/162
See application file for complete search history.

(56) References Cited

U.S. PATENT DOCUMENTS 822,562 A 6/1906 Tucker
2,482,367 A 9/1949 Ravers
2,810,401 A 10/1957 Stansbury
3,030,903 A 4/1962 Morris
4,285,368 A 8/1981 Terrill et al.
5,076,025 A 12/1991 Reeble
5,881,420 A 3/1999 Bruckelmyer
5,987,824 A 11/1999 Fuller
6,029,709 A 2/2000 Burgess
(Continued)

OTHER PUBLICATIONS

WIPO, PCT Form IPEA408, Written Opinion for International Patent Application Serial No. PCT/US2022/034620, pp. 5 (Jun. 7, 2023).

(Continued)

*Primary Examiner* — Brian E Glessner
*Assistant Examiner* — Daniel J Kenny
(74) *Attorney, Agent, or Firm* — UltimatEdge IP Law Group, P.C.; Dean G. Stathakis

(57) ABSTRACT

An anchored hole cover for a bore hole cored from a paved surface that includes a cover plate configured to cover the bore hole and support vehicular traffic. An anchoring mechanism is attached to the cover plate and extends down into the bore hole. The anchoring mechanism is configured to be actuated by a user torque input that is transmitted through a linkage system to cause an anchoring mechanism to selectively engage or disengage the wall of the bore hole. When the anchoring mechanism is engaged with the wall the anchoring mechanism is biased into contact with the hole, and is prevented from unintentional extraction. The anchored hole cover effectively provides a temporary cover for a bore hole in a road, parking lot, or other paved surfaces that supports vehicular traffic, that prevents extraction due to vibrations of passing traffic, thus preventing damage to cars and their occupants.

20 Claims, 15 Drawing Sheets

(56) References Cited

U.S. PATENT DOCUMENTS

| | | | | |
|---|---|---|---|---|
| 6,488,440 | B1 | 12/2002 | Hill | |
| 6,739,796 | B1 | 5/2004 | Del Nero et al. | |
| 7,717,136 | B2 * | 5/2010 | Sakai | F16L 55/1018 138/94 |
| 7,752,824 | B2 * | 7/2010 | Brown | F16B 21/16 52/223.13 |
| 8,052,121 | B2 * | 11/2011 | Christie | B66F 3/12 254/122 |
| 8,661,758 | B2 | 3/2014 | Longhenry | |
| 8,689,488 | B2 | 4/2014 | Rodrigue et al. | |
| 9,340,988 | B2 | 5/2016 | Lyristakis | |
| 9,700,943 | B2 | 7/2017 | Vicario Burgos et al. | |
| 10,640,996 | B2 | 5/2020 | Hartman | |
| 11,365,524 | B1 | 6/2022 | Reardon et al. | |
| 2012/0036787 | A1 | 2/2012 | Rodrigue et al. | |
| 2014/0252292 | A1 | 9/2014 | Clarke et al. | |
| 2014/0334876 | A1 | 11/2014 | Reynolds et al. | |
| 2015/0020458 | A1 | 1/2015 | Sinclair | |
| 2015/0204046 | A1 | 7/2015 | Taylor | |
| 2016/0053458 | A1 | 2/2016 | Stadler | |
| 2016/0160532 | A1 | 6/2016 | Patino et al. | |
| 2017/0073921 | A1 | 3/2017 | Mitola et al. | |
| 2017/0226714 | A1 | 8/2017 | Mitola et al. | |
| 2019/0136483 | A1 | 5/2019 | Nolle et al. | |
| 2019/0359461 | A1 | 11/2019 | Gretz | |
| 2020/0087884 | A1 | 3/2020 | Rigby | |
| 2021/0102354 | A1 | 4/2021 | Shokouhi | |

OTHER PUBLICATIONS

WIPO, PCT Form ISA210, International Search Report for International Patent Application Serial No. PCT/US2022/034620, pp. 4 (Oct. 12, 2022).

WIPO, PCT Form ISA237, Written Opinion for International Patent Application Serial No. PCT/US2022/034620, pp. 8 (Oct. 12, 2022).

* cited by examiner

ANCHORED HOLE COVER

BACKGROUND

This application is a continuation-in-part that claims the benefit of priority and is entitled to the filing date pursuant to 35 U.S.C. § 120 of U.S. Non-Provisional Patent Application No. 17/357,820, filed Jun. 24, 2021, the content of which is hereby incorporated by reference in its entirety.

The subject of this patent application relates generally to temporary covers for covering holes in paved surfaces so that vehicular traffic can safely travel thereover.

By way of background, when locating and verifying subsurface utilities (e.g., water, power, gas, telephone, sewer, cable, oil lines, reclaimed water, and so on) it is common practice to core approximately a 6-inch to 12-inch diameter hole though the asphalt or concrete. Once the asphalt or concrete core is removed, the field crew will then hydro excavate down to the utility to positively identify the line. Thereafter, the core is left open with the utility exposed to allow for survey crews, inspection crews, digging crews, drilling crews to visually identify the line they are working with and/or around.

During non-working hours, a cover (called a "graduation cap" due to its appearance) is placed over the core hole to permit safe passage of pedestrians and vehicular traffic. Many current graduation caps are made from heavy-duty steel materials, with a large diameter steel pipe having a steel plate welded to the top end. The pipe portion is dropped into the bore hole, with the plate resting atop the rim of the hole, with only the weight of the graduation cap holding it within the hole. As high-speed vehicles drive over the plate, the graduation caps have issues with becoming dislodged from the core and ejected onto the street. This causes great damage to vehicles due to impact with the dislodged graduation cap and/or the open bore hole itself. What is needed is a bore hole cover that can withstand the stresses of vehicular traffic without becoming dislodged.

Aspects of the present invention fulfill these needs and provide further related advantages as described in the following summary.

SUMMARY

Aspects of the present invention teach certain benefits in construction and use which give rise to the exemplary advantages described below.

The present specification discloses an anchored hole cover generally comprising a cover plate coupled to an anchoring mechanism. The cover plate includes a top surface and a bottom surface opposite the top surface. The anchoring mechanism includes an actuator tool engagement portion mechanically connected to a bore hole engagement portion through a linkage system. A linkage biasing mechanism is included with a spring element that biases the linkage system radially outward when the spring element is deflected. The anchoring mechanism is coupled with the cover plate and extends from the bottom surface of the cover plate. During an insertion procedure, the anchoring mechanism is configured to be positioned within the bore hole and supported at least initially therein by the cover plate that is configured to rest upon the paved surface and substantially cover the bore hole. And, during a fastening procedure, the actuator tool engagement portion of the anchoring mechanism is configured to be actuated to cause a first movement through the linkage system to move the bore hole engagement portion into anchoring contact with the bore hole and to deflect the spring element to substantially prevent extraction of the anchoring mechanism from the bore hole and to substantially prevent lifting of the cover plate due to forces exerted by vehicular traffic thereupon.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings, which are incorporated in and constitute a part of this specification, illustrate aspects of the disclosed subject matter in at least one of its exemplary embodiments, which are further defined in detail in the following description. Features, elements, and aspects of the disclosure are referenced by numerals with like numerals in different drawings representing the same, equivalent, or similar features, elements, or aspects, in accordance with one or more embodiments. The drawings are not necessarily to scale, emphasis instead being placed upon illustrating the principles herein described and provided by exemplary embodiments of the invention. In such drawings.

and

Figure 20:
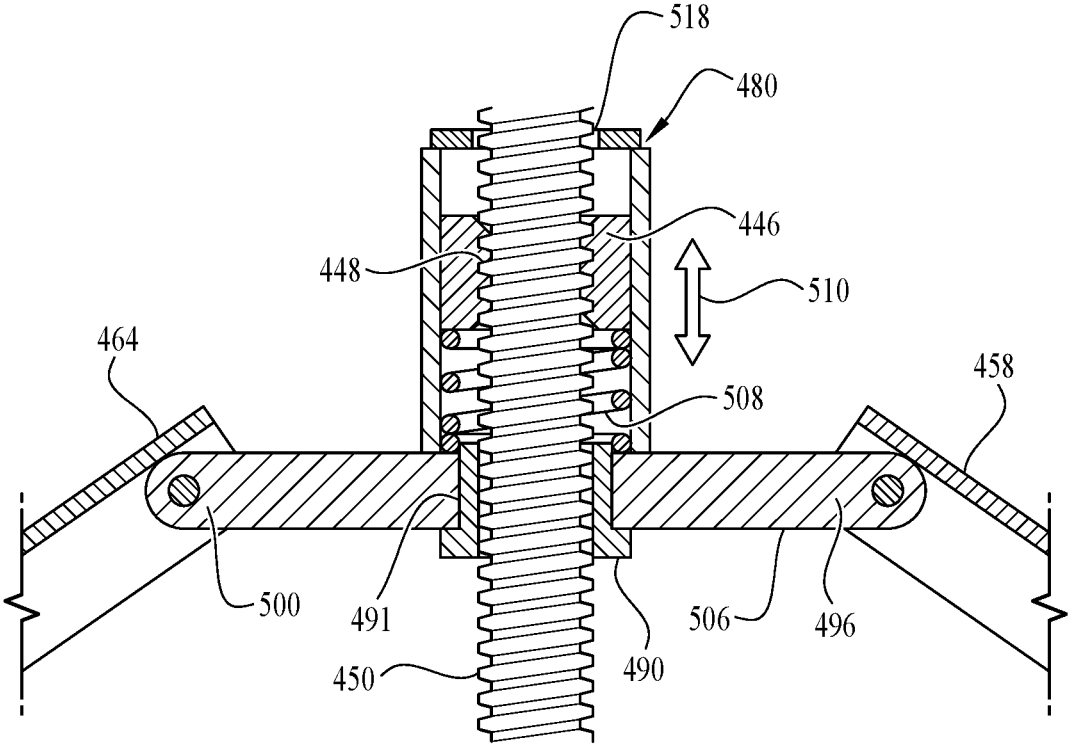

FIG. 20 is a magnified cross-sectional view of a linkage biasing system of the present anchored hole cover, illustrating the spring in a compressed state.

Listing of Reference Numbers Associated with Drawings

| Ref. No. | Element |
|---|---|
| 20 | Anchored hole cover |
| 22 | Cover plate |
| 24 | Anchoring mechanism |
| 26 | Top surface |
| 28 | Bottom surface |
| 30 | Actuator tool access opening |
| 32 | Actuator tool engagement portion |
| 34 | Bore hole engagement portion |
| 36 | Linkage system |
| 37 | Major face |
| 38, 39 | Hooking extension |
| 40 | Scissor linkage |
| 41 | Leading edge |
| 42 | Stationary trunnion |
| 44 | Clearance hole |
| 46 | Drive trunnion |
| 48 | Threaded hole |
| 50 | Drive screw |
| 52 | Head |
| 54 | First upper arm |
| 56 | Second upper arm |
| 58 | First lower arm |
| 60 | Second lower arm |
| 62 | First engagement bracket |
| 64 | Second engagement bracket |
| 66 | Second bore hole engagement portion |
| 68 | Twist lock mechanism |
| 70 | Anchoring mechanism support bracket |
| 72 | Locking socket |
| 74 | Locking plate |
| 76 | Trunnion body |
| 78 | Retaining groove |
| 80 | Retaining washer |
| 82 | Retaining socket |
| 84 | Retaining plate locating feature |
| 86 | Retaining washer locating feature |
| 88 | Support plate |
| 90 | Sidewall |
| 92 | Top edge |
| 220 | Anchored hole cover |
| 222 | Cover plate |
| 224 | Anchoring mechanism |
| 226 | Top surface |
| 228 | Bottom surface |
| 230 | Actuator tool access opening |
| 232 | Actuator tool engagement portion |
| 234 | Bore hole engagement portion |
| 236 | Linkage system |
| 238 | Pin-in-slot cam linkage |
| 240 | Top stationary cam plate |
| 242 | Bottom stationary cam plate |
| 244 | Drive cam plate |

-continued

Listing of Reference Numbers Associated with Drawings

| Ref. No. | Element |
|---|---|
| 246 | First frame bracket |
| 248 | Second frame bracket |
| 250 | Third frame bracket |
| 252 | Top first linear pin slot |
| 254 | Top second linear pin slot |
| 256 | Top third linear pin slot |
| 257 | Edge |
| 258 | Top clearance hole |
| 260 | Bottom first linear pin slot |
| 262 | Bottom second linear pin slot |
| 264 | Bottom third linear pin slot |
| 266 | Bottom clearance hole |
| 268 | First curved pin slot |
| 270 | Second curved pin slot |
| 271 | Third curved pin slot |
| 272 | First rod |
| 274 | Second rod |
| 276 | Third rod |
| 278 | First piercing tip |
| 280 | Second piercing tip |
| 282 | Third piercing tip |
| 284 | First elongated nock |
| 286 | Second elongated nock |
| 288 | Third elongated nock |
| 290 | First pin through hole |
| 292 | Second pin through hole |
| 294 | Third pin through hole |
| 296 | First pin |
| 298 | Second pin |
| 300 | Third pin |
| 302 | Motion checking mechanism |
| 304 | Ball-nose spring plunger |
| 306 | Detent holes |
| 308 | Adjustment screw |
| 310 | Weld nut |
| 312 | Opening |
| 314 | First rod guide hole |
| 316 | Second rod guide hole |
| 318 | Third rod guide hole |
| 320 | Notch |
| 322 | First traveling intersection |
| 324 | Second traveling intersection |
| 326 | Third traveling intersection |
| 328 | Edge |
| 420 | Anchored hole cover |
| 422 | Cover plate |
| 424 | Anchoring mechanism |
| 426 | Top surface |
| 428 | Bottom surface |
| 430 | Actuator tool access opening |
| 432 | Actuator tool engagement portion |
| 434 | Bore hole engagement portion |
| 436 | Linkage system |
| 440 | Scissor linkage |
| 442 | Trunnion plate |
| 444 | Clearance hole |
| 446 | Drive trunnion |
| 448 | Threaded hole |
| 450 | Drive screw |
| 452 | Head |
| 454 | First upper arm |
| 456 | Second upper arm |
| 458 | First lower arm |
| 460 | Second lower arm |
| 462 | Third upper arm |
| 464 | Third lower arm |
| 466 | Second bore hole engagement portion |
| 468 | Third bore hole engagement portion |
| 470 | Anchoring mechanism support bracket |
| 471 | Bracket sidewall |
| 472 | Bottom washer |
| 474 | Bottom retaining ring |
| 476 | Top washer |
| 478 | Top retaining ring |
| 480 | Biasing system housing |

-continued

| Listing of Reference Numbers Associated with Drawings | |
|---|---|
| Ref. No. | Element |
| 482 | First upper pivot mount |
| 484 | Second upper pivot mount |
| 486 | Third upper pivot mount |
| 488 | Pin |
| 490 | Sleeve |
| 491 | Through hole |
| 492 | Collar |
| 494 | Collar screw |
| 496 | First lower pivot mount |
| 498 | Second lower pivot mount |
| 500 | Third lower pivot mount |
| 502 | Upper retaining groove |
| 504 | Lower retaining groove |
| 506 | Drive trunnion plate |
| 508 | Drive trunnion spring |
| 510 | Arrow |
| 512 | Linkage biasing system |
| 514 | Biasing housing top plate |
| 516 | Biasing housing side wall |
| 518 | Biasing housing through hole |
| 520 | Sleeve through hole |
| 521 | Interior space |
| H | Bore hole |
| W | Bore hole wall |
| P | Paved surface |
| B | Base |
| S | Subgrade |
| U | Utility |

DETAILED DESCRIPTION

The present specification discloses an anchored hole cover for a bore hole cored from a paved surface that includes a cover plate configured to cover the bore hole and support vehicular traffic. An anchoring mechanism is attached to the cover plate and extends down into the bore hole. The anchoring mechanism is configured to be actuated by a user torque input that is transmitted through a linkage system to cause an anchoring mechanism to selectively engage or disengage the wall of the bore hole. When the anchoring mechanism is engaged with the wall, the anchored hole cover is prevented from being unintentionally extracted from the hole. The anchored hole cover effectively provides a temporary cover for a bore hole in a road, parking lot, or other paved surfaces that supports vehicular traffic, that prevents extraction due to vibrations of passing traffic, thus preventing damage to cars and their occupants.

Figure 1:
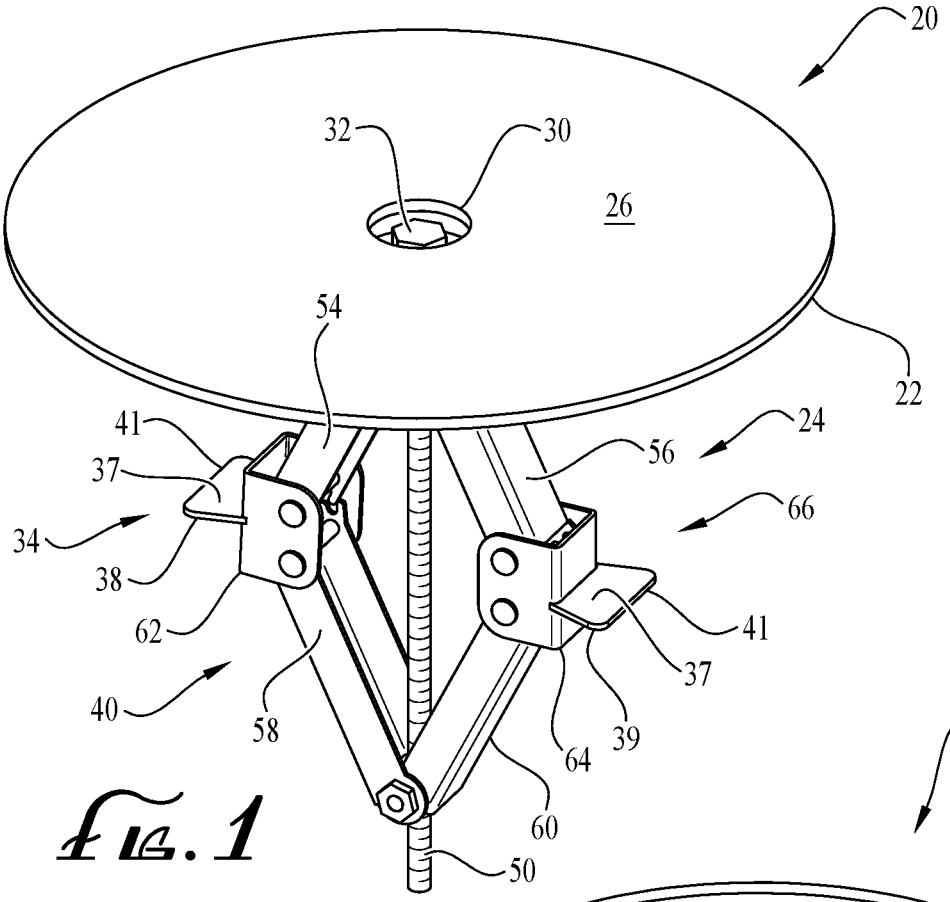
FIG. 1 is an assembled top perspective view of an exemplary embodiment of an anchored hole cover disclosed herein.
Figure 2:
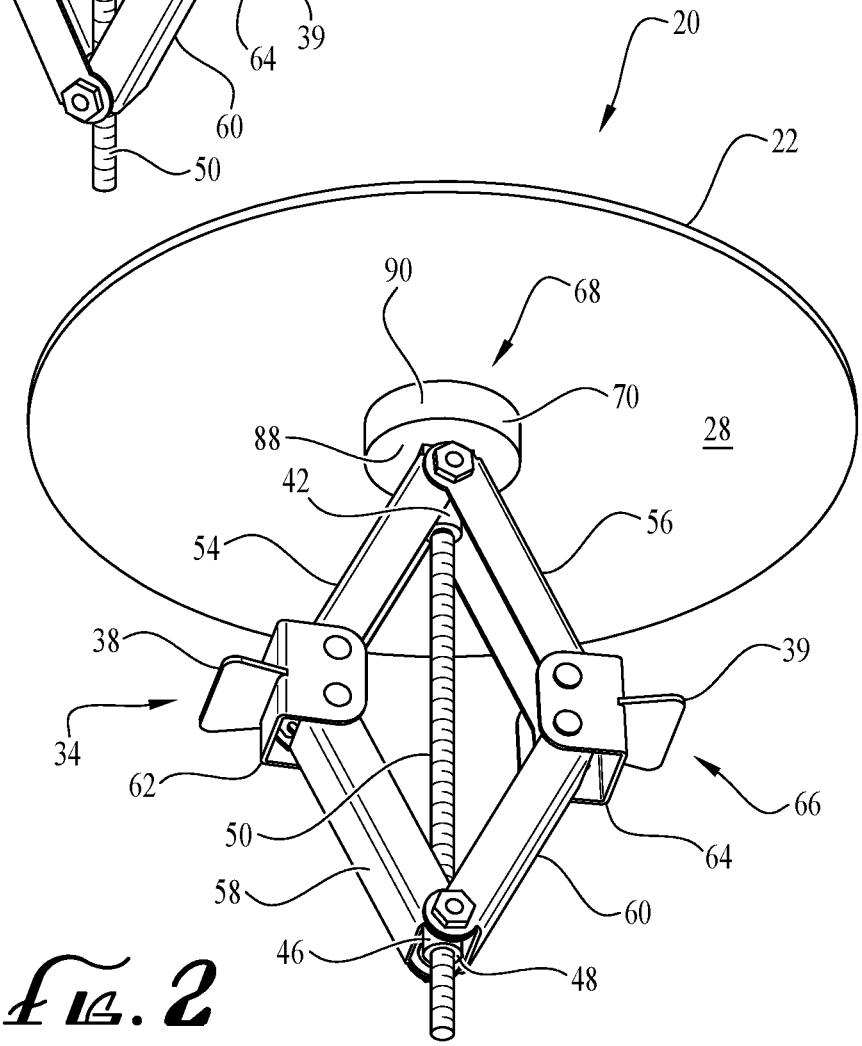
FIG. 2 is an assembled bottom perspective view of the anchored hole cover of FIG. 1.
Figure 3:
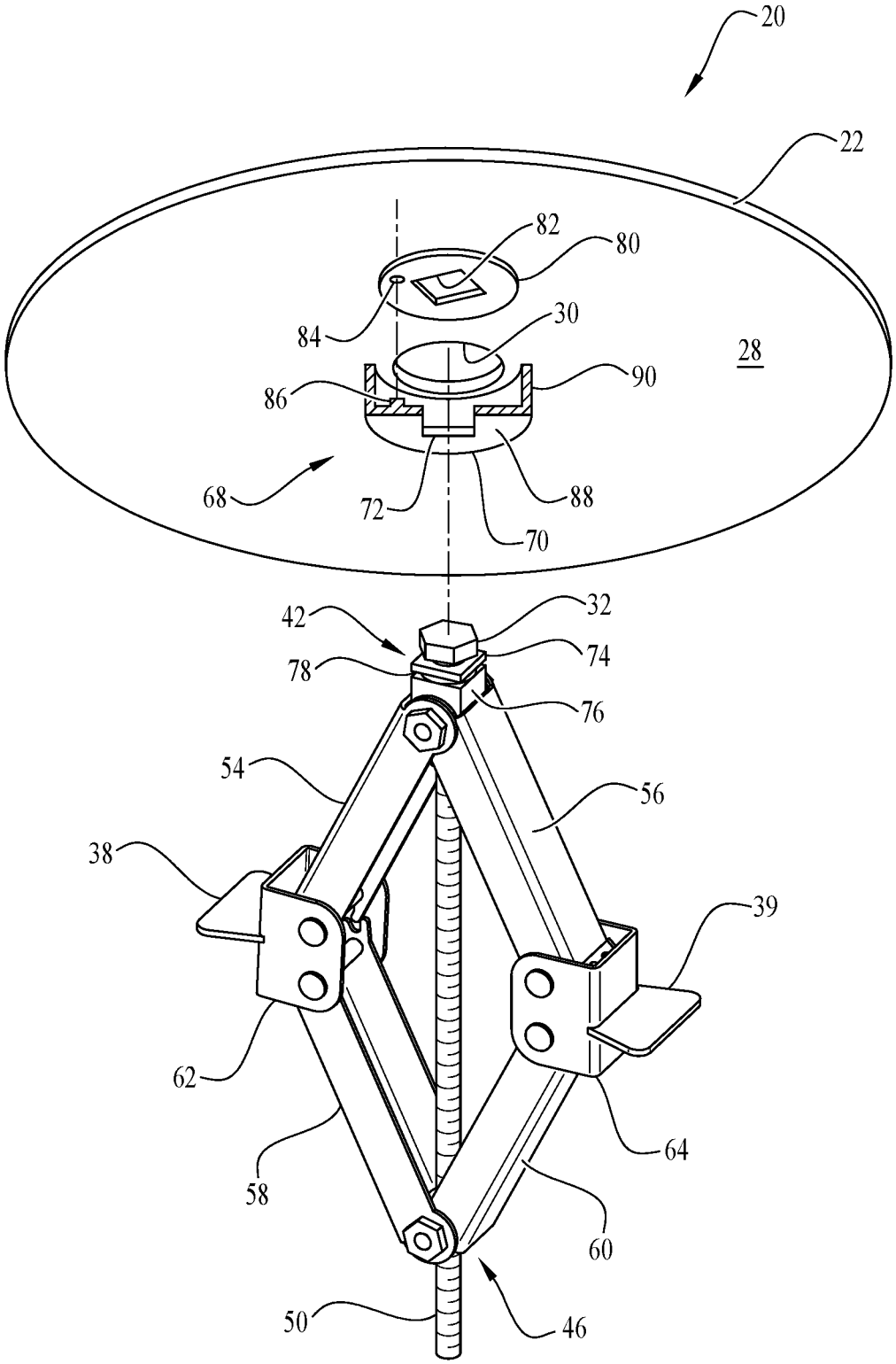
FIG. 3 is an exploded perspective view of the anchored hole cover of FIG. 1.

Referring first to FIGS. 1-3, an example embodiment of the present anchored hole cover 20 is illustrated, and generally includes a cover plate 22 with an anchoring mechanism 24 coupled thereto and extending from the bottom surface 28 of the cover plate 22. The anchoring mechanism 24 can have a variety of configurations that covert a user torque input into radial or lateral expansion to grip, hook, and/or pierce the walls W of the bore hole H (as exemplified in FIGS. 5 & 11). The anchoring mechanism 24 general includes an actuator tool engagement portion 32 which is, in one or more embodiments, accessed by an actuator tool (e.g., a socket wrench, a T-handle wrench, a speed or crack handle wrench, impact wrench, and numerous other hand or power tools that can be used to impart a torque on the actuator tool engagement portion 32) through an actuator tool access opening 30. The actuator tool engagement portion 32 is mechanically connected to the bore hole engagement portion 32 through a linkage system 36. Thus, upon actuation (applied through a user torque input), the linkage system 36 amplifies the magnitude of the torque and/or converts the torque to generally lateral movement of the bore hole engagement portion 32 (e.g., movement between the center of the bore hole H toward/from the bore hole H wall W).

In the illustrated example embodiment of FIGS. 1-6, the actuator tool engagement portion 32 is the head 54 of a drive screw 50; the linkage system 36 is a scissor linkage 40; and the bore hole engagement portions 34, 66 are hooking extensions 38, 39 protruding respectively from the first engagement bracket 62 and the second engagement bracket 64, and are configured to move to engage and disengage the wall W of the bore hole H or some other portion of the bore hole H in response to the torque input. In this illustrated example, the hooking extensions 38, 39 are shown as tab-like extensions that are laterally oriented (e.g., a major face 37 is substantially level with the ground or perpendicular to gravity), although the orientation of the hooking extensions 38, 39 is variable according to the requirements of the design. Further, although the text herein refers to the tabs as hooking extensions 38, 39, these may also be used to directly contact the wall W to create frictional engagement and/or to pierce into the wall W to create a piercing engagement, if desired. Thus, the hooking extensions 38, 39 are not merely limited to hooking a portion of the bore hole H. Further, the major face 37 and leading edge 41 of the hooking extensions 38, 39 can have a variety of shapes and configurations, such as a curvilinear or linear leading edge 41, a triangular-shaped major face 37 resulting in a pointed leading edge 41, a rectangular-shaped or trapezoidal-shaped major face 37. Moreover, the hooking extensions 38, 39 are not necessarily tab-shaped; and, in one or more embodiments, are laterally directed (i.e., directed radially within the bore hole H) spikes, rods, or other extension that can hook, pierce, or otherwise engage the wall W of the bore hole H. In other words, although the hooking extensions 38, 39 are named after the function, hooking, the structures are also capable of other forms of anchoring, such as piercing, frictional engagement, etc. Additionally, the hooking extensions 38, 39 can be replaced entirely with another form of anchor, such as a brake shoe-like curved anchors, that are configured to grip the wall and include a radius similar to the bore hole H radius.

The scissor linkage 40 is comprised of a first upper arm 54 pivotally coupled end-to-end to a second upper arm 56 through the stationary trunnion 42. The stationary trunnion 42 serves multiple purposes, which will be described in further detail below, and acts as a hinge connecting the first upper arm 54 and the second upper arm 56. The first upper arm 54 is further coupled end-to-end to a first lower arm 58 through the first engagement bracket 62. The first engagement bracket 62 serves as a hinge and as a gear bracket to hold the gear teeth formed at the mating ends of each of the first upper arm 54 and the first lower arm 58 in meshed engagement to maintain the orientation of the first engagement bracket 62. The second upper arm 56 is further coupled end-to-end to a second lower arm 60 through the second engagement bracket 64. The second engagement bracket 64, likewise, serves as a hinge and as a gear bracket to hold the gear teeth formed at the mating ends of each of the second upper arm 56 and the second lower arm 60 in meshed engagement to maintain the orientation of the second engagement bracket 64. Enclosing the linkage, the first lower arm 58 is coupled end-to-end with the second lower arm 60 through a drive trunnion 46. The drive trunnion 46 serves multiple purposes, which will be described in further detail below, and acts as a hinge connecting the first lower arm 58 and the second lower arm 60.

The stationary trunnion 42 further includes a stationary trunnion body 76 that couples the first upper arm 54 and the second upper arm 56 in a hinged arrangement. A retaining groove 78 is formed about at least part of or the entire the stationary trunnion body 76 to define a locking plate 74 on the stationary trunnion body 76. Although the locking plate 74 is plate-like in the illustrated embodiment, the locking plate 74 can be thicker and not plate-like if required. A clearance hole 44 is formed through the stationary trunnion body 76 and the locking plate 74, formed perpendicular to the top surface of the locking plate 74. The clearance hole 44 is configured to receive therethrough the drive screw 50, where the drive screw 50 spans across the linkage to the drive trunnion 46 and threads into the threaded hole 48 of the drive trunnion 46. Thus, as the drive screw 50 is rotated by engagement and rotation of the head 52, the drive trunnion 46 is forced to travel up or down the drive screw 50 (depending on which direction the drive screw 50 is rotated) bringing the drive trunnion 46 respectively closer to or further from the stationary trunnion 42.

Figure 4:
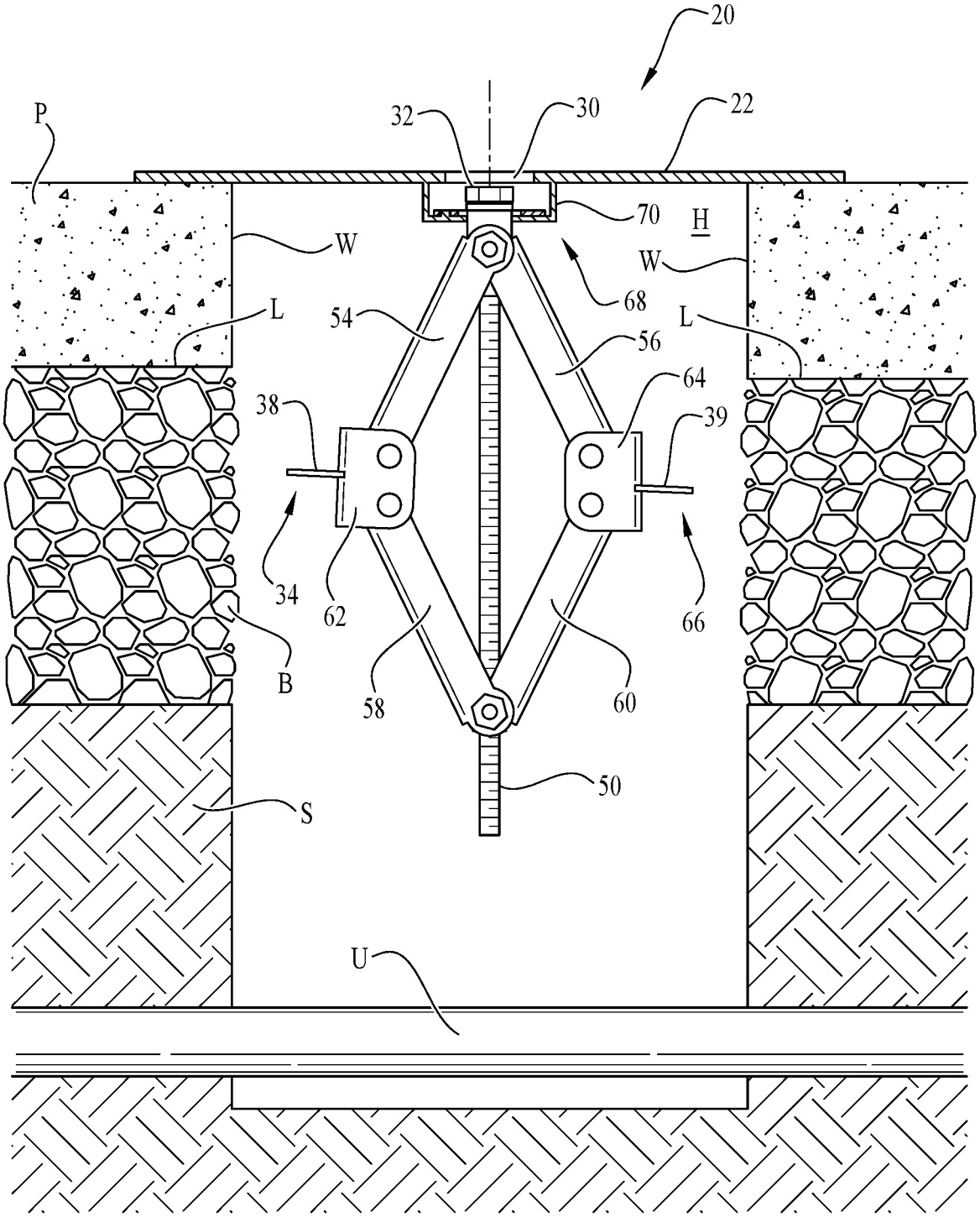
FIG. 4 is a side view of the present anchored hole cover of FIG. 1, showing the anchored hole cover inserted within a bore hole formed through a paved surface in the unanchored configuration.
Figure 5:
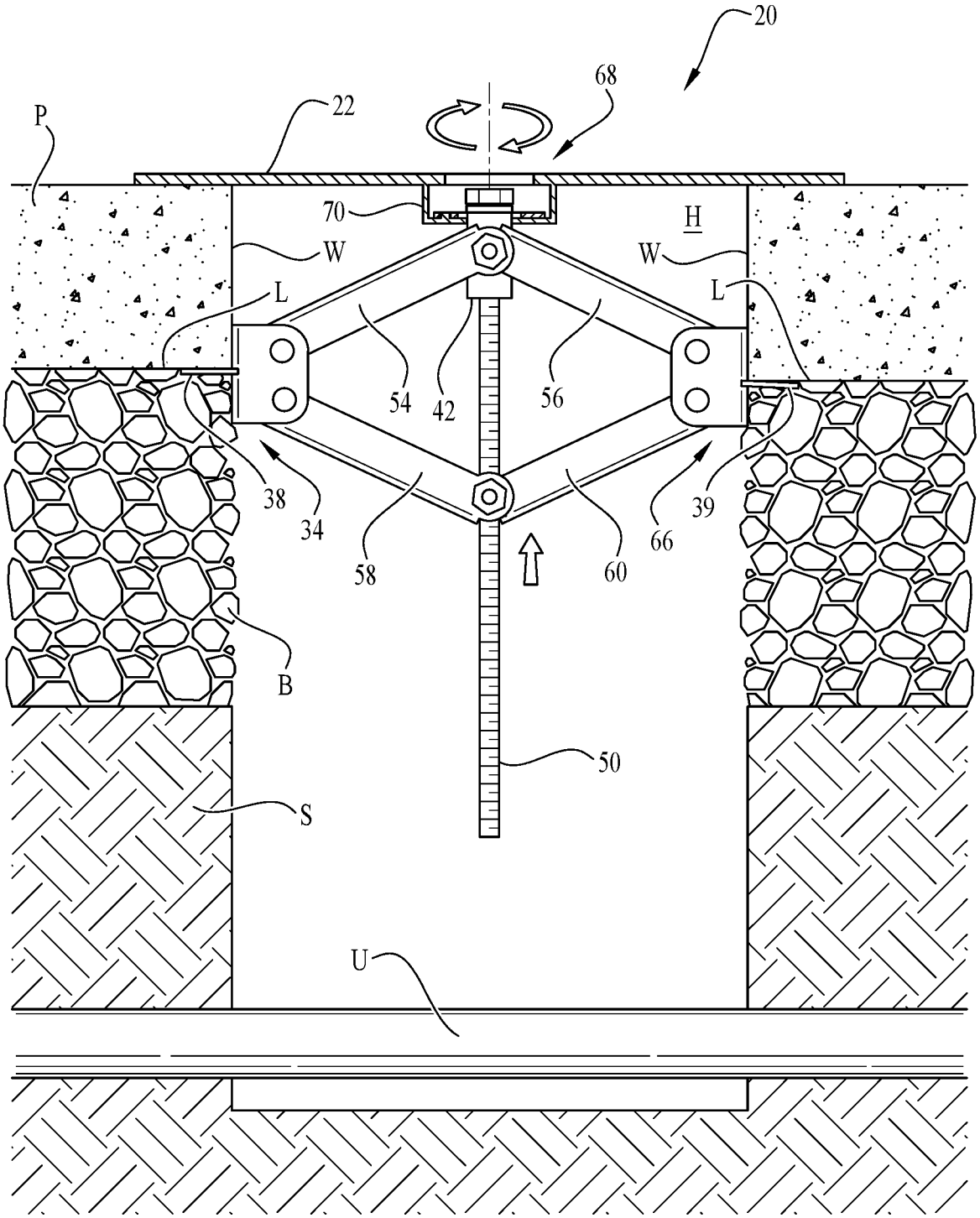
FIG. 5 is a side view of the present anchored hole cover of FIG. 1, showing the anchored hole cover in the anchored configuration.

In the example embodiment, the actuator tool would be used to rotate the head 52 of the drive screw 50 in a clockwise direction to draw the drive trunnion 46 toward the stationary trunnion 42. This action causes the upper arms 54, 56 and the lower arms 58, 60 transitions from a more vertical orientation to a more horizontal orientation, causing the first engagement bracket 62 and the second engagement bracket 64 to move toward their respective portions of the wall W of the bore hole H to transition to the anchored configuration, as seen in FIG. 5. Conversely, when the drive screw 50 is rotated in a counterclockwise direction the drive trunnion 46 is pushed away from the stationary trunnion 42, which causes the upper arms 54, 56 and the lower arms 58, 60 transitions from a more horizontal orientation to a more vertical orientation. This causes the first engagement bracket 62 and the second engagement bracket 64 to move away from their respective portions of the wall W of the bore hole H to transition to the unanchored configuration, as seen in FIG. 4.

Figure 6A:
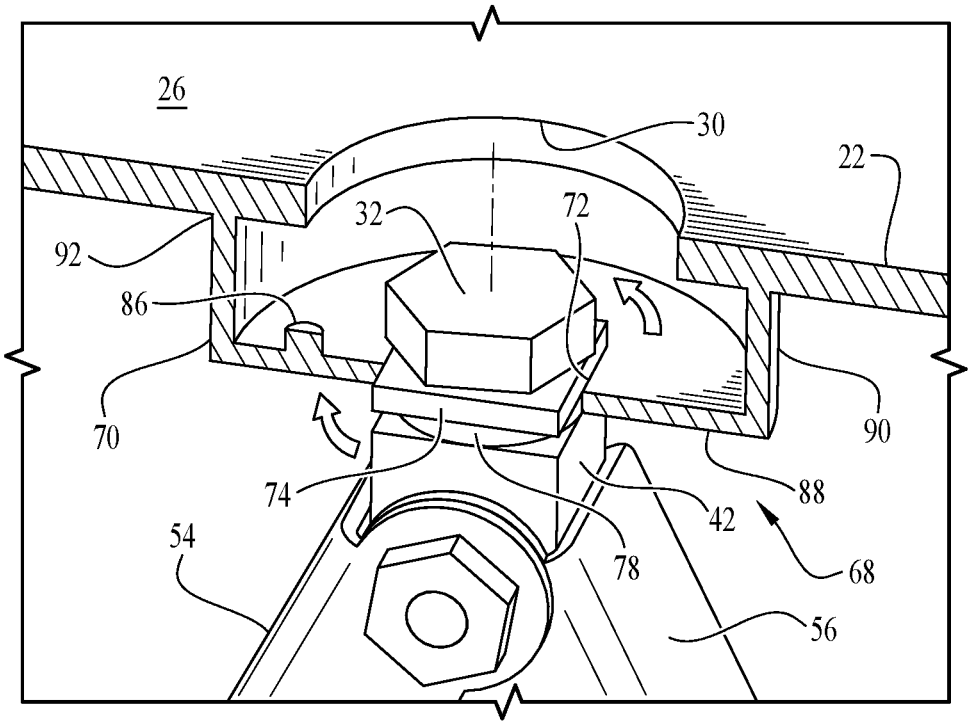
FIG. 6A is a magnified partial cross-sectional perspective view of the anchored hole cover of FIG. 1, showing the twist lock mechanism being rotated into the locked configuration.
Figure 6B:
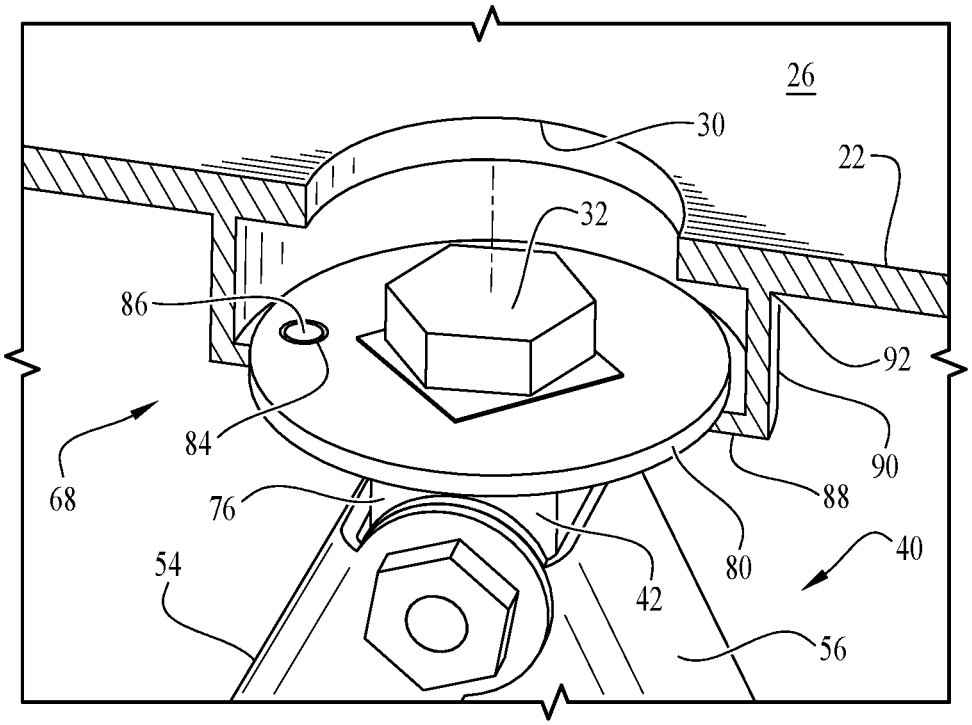
FIG. 6B is a magnified partial cross-sectional perspective view of the anchored hole cover of FIG. 6A, showing the twist lock mechanism in the locked configuration.

FIGS. 3 and 6A-B illustrate an example twist lock mechanism 68 that serves to couple the scissor linkage 40 to the cover plate 22, to permit disassembly of the scissor linkage 40 to the cover plate 22, and, as the drive screw 50 is rotated, to prevent the rotation of the remaining portions of the scissor linkage 40 (i.e., the upper arms 54, 56, the lower arms 58, 60, the stationary trunnion 42, the drive trunnion 46, the first and second engagement brackets 62, 64, etc.) relative to the cover plate 22, and so that the bore hole engagement portions 32, 66 do not substantially rotate relative to the wall W of the bore hole H. The twist lock mechanism 68 allows the user to quickly assemble and disassemble the anchor hole cover 20 so that it can be compactly stowed when not in use and easily carried in two parts.

The twist lock mechanism 68 is generally comprised of an anchoring mechanism support bracket 70, a locking plate 74, and a retaining washer 80. In one or more examples, the anchoring mechanism support bracket 70 is an enclosure or other framework attached to or integral with the cover plate 22, and extending from the bottom surface 28 (i.e., facing into the bore hole H when installed) of the cover plate 22. In the illustrated example, the anchoring mechanism support bracket 70 includes a sidewall 90 attached to the bottom surface 28 of the cover plate 22 by the top edge 92 (for example, by welding the top edge 92 to the bottom surface 28), a support plate 88 connected to the sidewall, and a locking socket 72 formed through the support plate 88. In one or more embodiments, the support plate 88 is horizontally oriented (i.e., level with the ground).

In one or more embodiments, the locking socket 72 is rectangular; and, more specifically, a square through hole in this example. The locking plate 74 is sized to fit through the locking socket 72 in a first rotational position, where the rotation is about the axis of the drive screw 50. Locking plate 74 is sized to not fit through the locking socket 72 in a second rotational position. In other words, the locking plate 74 includes a first dimensional size sufficiently small to permit the locking plate 74 to fit through the locking socket 72 in the first rotational position, and includes a second dimensional size sufficiently large to block the locking plate 74 from fitting through the locking socket 72 in the second rotational position. Here, the locking plate 74 is a square that is slightly smaller in size than the square opening of the locking socket 72. Thus, the first dimensional size is the distance from one parallel side to the opposite parallel side; and the second dimensional size is the distance from one corner of the square to the opposite corner.

The locking plate 74 is located at the top end of the scissor linkage 40, integral with or coupled to the stationary trunnion body 76, and is square shaped in the illustrated example. The locking socket 72 is also square-shaped and sufficiently large to permit insertion therethrough of the locking plate 74. The locking plate 74 and the scissor linkage 40 are constrained to rotate in unison, such that, when the locking plate 74 is held stationary and not permitted to rotate, the scissor linkage 40 is also not permitted to rotate. To assemble the anchored hole cover 20, the user inserts the locking plate 74 through the locking socket 72, with the two aligned to permit insertion. Then, the scissor linkage 40 is rotated, for example, approximately a quarter turn, to rotate the locking plate 74 relative to the locking socket 72, with at least a portion of the edge of the locking socket 72 positioned within the retaining groove 78. The entire weight of the scissor linkage 40 is supported by the corners of the square locking plate 74 resting atop the edge of the locking socket 72 when the two are twisted out of alignment.

Once the locking plate 74 and locking socket 72 are twisted out of alignment, such that the locking plate 74 cannot be extracted, the misaligned position of the locking plate 74 must be held by a retainer with a locating feature. In the illustrated example, the retaining washer 80 includes a retaining socket 82 that is configured to receive therein the locking plate 74, with the locking plate 74 resting within the retaining socket 82. The retaining washer 80 further includes a retaining plate locating feature 84 (configured to locate on a mating feature on the support plate 88), which is a hole in this example. The retaining plate locating feature 84 is configured to receive therewithin a retaining washer locating feature 86 (configured to locate the retaining washer 80) on the anchoring mechanism support bracket 70, which is a stud or other protrusion extending upwardly from the support plate 88. In this way, when the locking plate 74 is within the locking socket 72 and the retaining washer locating feature 86 is positioned within the retaining plate locating feature 84, the misaligned orientation of the locking plate 74 is locked and the locking plate 74 is not permitted to rotate, and unintentional retraction is not possible.

In this example, the retaining washer 80 is enclosed within the anchoring mechanism support bracket 70 and can be accessed through the actuator tool access opening 30 in the cover plate 22. If there is an unexpected problem with the scissor linkage 40 below, which prohibits removal of the anchored hole cover 20 from the bore hole H, the user can extract the retaining washer 80 from engagement with the retaining features 84, 86 so that the locking plate 74 can be rotated into alignment with the locking socket 72, to permit the cover plate 22 to be detached and removed from the scissor linkage 40.

Looking now at FIGS. 4 and 5, the insertion and fastening procedures, respectively, can be seen. The bore hole H is formed by coring through the paved surface P (e.g., asphalt, concrete, or other form of paved surface appropriate for supporting vehicular traffic on a roadway, parking lot, or other area). The bore hole H is further dug through any other layers beneath the paved surface P, such as the illustrated base B or subgrade S layers, until the utility U is sufficiently exposed. The anchored hole cover 20 is inserted within the bore hole H, with the scissor linkage 40 positioned within the bore hole H. The cover plate 22 is sized larger than the bore hole H, so that the cover plate 22 rest on top of the paved surface P. The bore hole engagement portions 34, 66 are positioned so that they can engage any portion of the bore hole H, including the portion of the wall W or bottom ledge L of the bore hole H comprising the paved surface P. Turning to FIG. 5, the head 52 of the drive screw 50 is rotated in a clockwise direction using an appropriate tool to provide the required torque, from the point of view of the user standing on top of the paved surface P. This clockwise rotation causes the drive trunnion 46 to move upward on the drive screw 50, thus pushing the bore hole engagement portions 34, 66 oppositely outward and toward the wall W of the bore hole H. In this example, the bore hole engagement portions 34, 66 are forced just beneath the paved surface layer P and pushed into the base B layer, so that the major faces 37 of each of the bore hole engagement portions 34, 66 are located beneath the ledge L of the paved surface P formed by the coring process. In this way, the overlap of the bore hole engagement portions 34, 66 beneath the ledge L create a mechanical interference that prohibits extraction of the anchored hole cover 20 from the bore hole H, even under maximum expected vehicular traffic conditions, such as class one vehicles (under 6,000 pounds) up to and exceeding class eight vehicles (over 33,000 pounds) traveling at highway speeds. To remove the anchored hole cover 20, the user simply rotates the head 52 of the drive screw 50 in the counterclockwise direction to disengage the bore hole engagement portions 34, 66 from the bore hole H wall W.

Referring now to FIGS. 7-13, another example embodiment of the present anchored hole cover 220 is disclosed, and generally includes a cover plate 222 with an anchoring mechanism 224 coupled thereto and extending from the bottom surface 228 of the cover plate 222. The anchoring mechanism 224 can have a variety of configurations that covert a user torque input into radial or lateral expansion to grip, hook, and/or pierce the walls W of the bore hole H. The anchoring mechanism 224 general includes an actuator tool engagement portion 232 which is, in one or more embodiments, accessed by an actuator tool (e.g., a socket wrench, a T-handle wrench, a speed or crack handle wrench, impact wrench, and numerous other hand or power tools that can be used to impart a torque on the actuator tool engagement portion 232) through a actuator tool access opening 230. The actuator tool engagement portion 232 is mechanically connected to the bore hole engagement portion 232 through a linkage system 236. Thus, upon actuation (applied through a user torque input), the linkage system 236 amplifies the magnitude of the torque and/or converts the torque to generally lateral movement of the bore hole engagement portion 232 (e.g., movement between the center of the bore hole H toward/from the bore hole H wall W).

Figure 7:
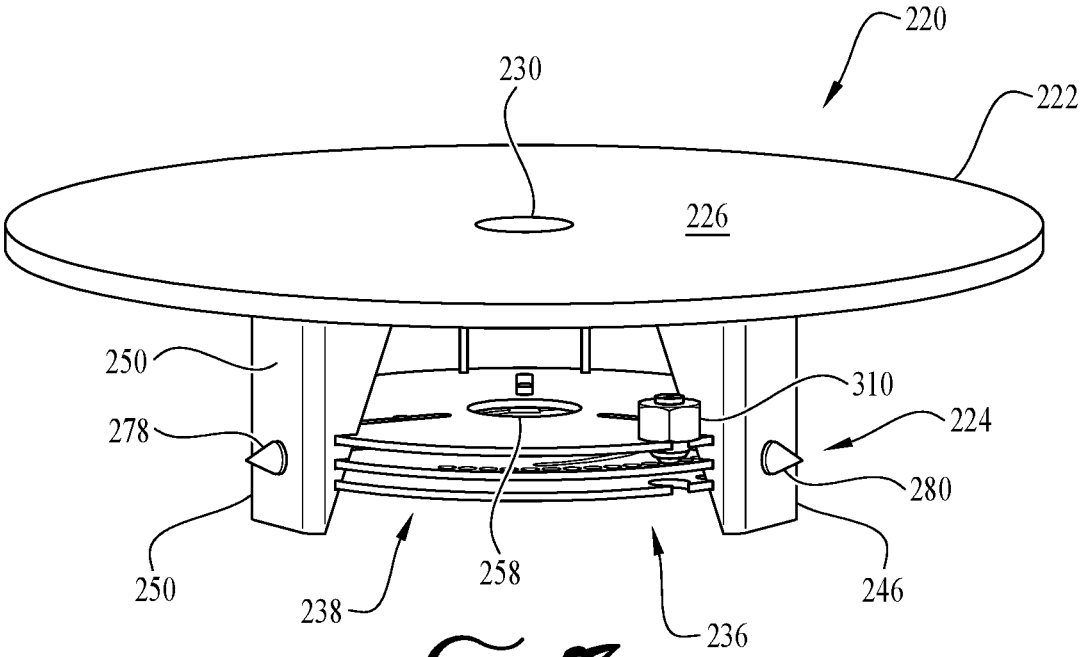
FIG. 7 is an assembled top perspective view of another exemplary embodiment of an anchored hole cover disclosed herein.
Figure 8:
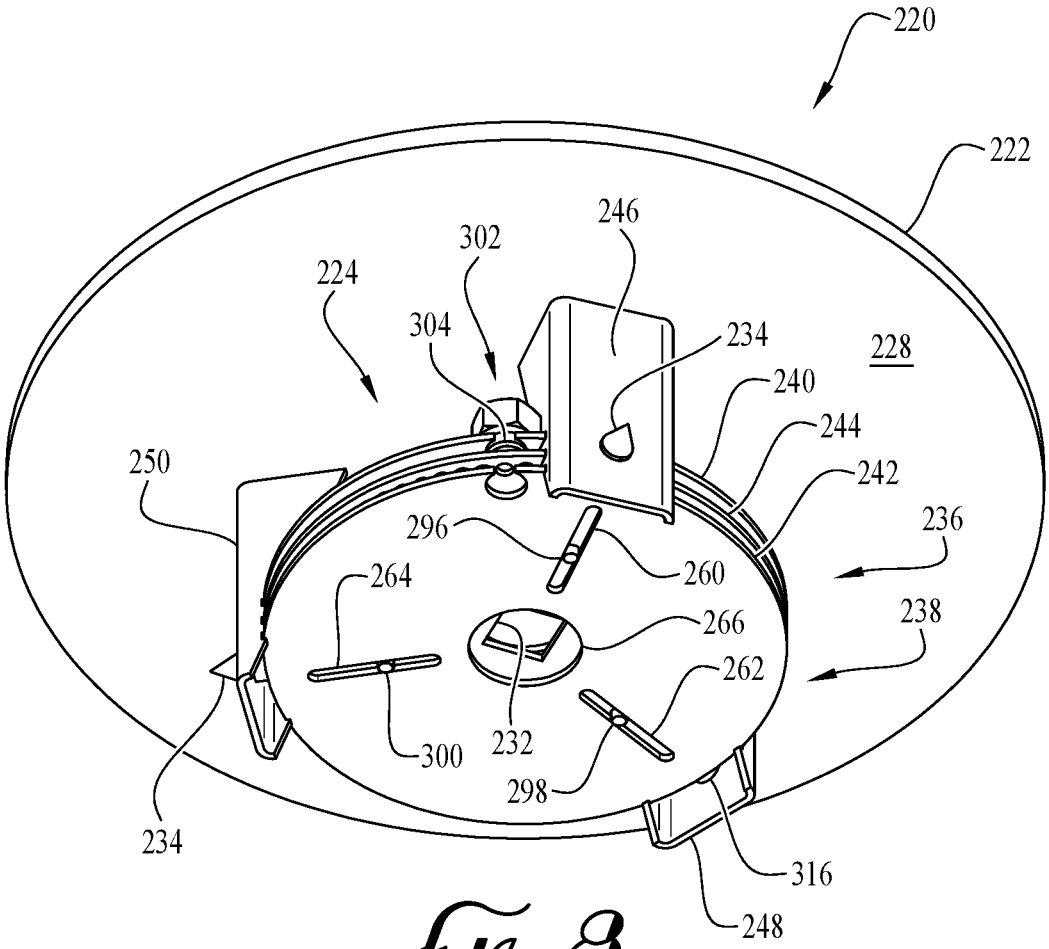
FIG. 8 is an assembled bottom perspective view of the anchored hole cover of FIG. 7.
Figure 9:
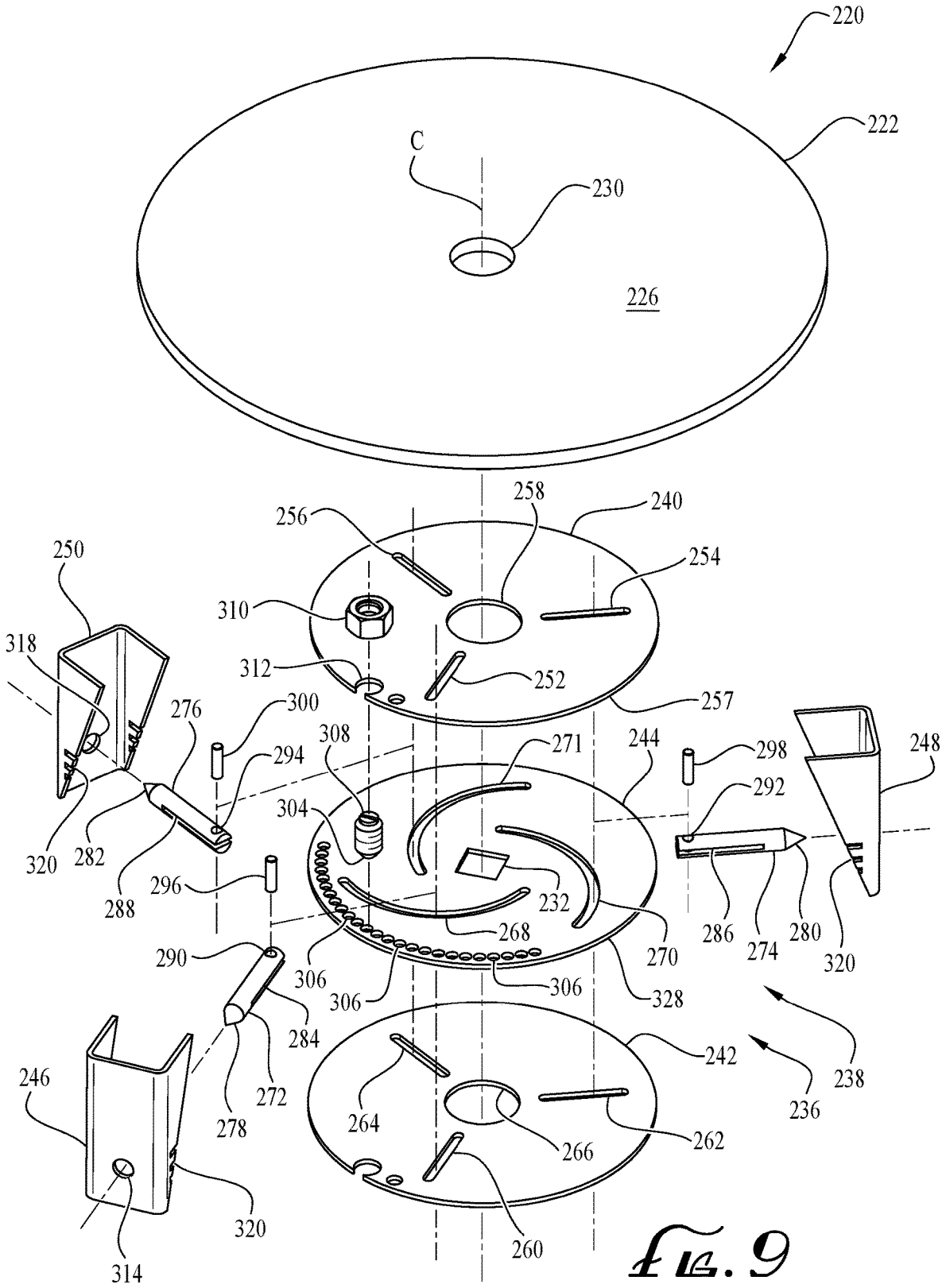
FIG. 9 is an exploded perspective view of the anchored hole cover of FIG. 7.

Looking particularly at FIGS. 7-9, the actuator tool engagement portion 232 is a square opening configured to receive a compatible square driver of a tool; the linkage system 236 is a pin-in-slot cam linkage 240; and the bore hole engagement portions 234 are a first rod 272, a second rod 274, and a third rod 276 laterally extendable to engage and disengage the wall W of the bore hole H or some other portion of the bore hole H in response to the torque input.

The pin-in-slot cam linkage 240 is comprised of top stationary cam plate 240, a bottom stationary cam plate 242, with a drive cam plate 244 inserted between the top stationary cam plate 240 and the bottom stationary cam plate 242. The top stationary cam plate 240, bottom stationary cam plate 242, and the drive cam plate 244 are aligned in a stacked arrangement with a spacing between each successive plate, being held in the spaced apart and stacked arrangement by a first frame bracket 246, a second frame bracket 248, and a third frame bracket 250, each extending down from the bottom surface 228 of the cover plate 222 (welded thereto or otherwise connected). The first frame bracket 246, the second frame bracket 248, and the third frame bracket 250 are arranged in to surround the stacked arrangement of the top stationary cam plate 240, bottom stationary cam plate 242, and the drive cam plate 244. The top stationary cam plate 240 and the bottom stationary cam plate 242 are rigidly attached to the first frame bracket 246, the second frame bracket 248, and the third frame bracket 250 to prevent rotation of the top stationary cam plate 240 and the bottom stationary cam plate 242. The drive cam plate 244 is permitted to rotate relative to the first frame bracket 246, the second frame bracket 248, and the third frame bracket 250, where each bracket includes one or more notches 320 to into which the edge of the drive cam plate 244 (which is circular in shape in this example) is received and permitted twist therewithin by sliding through the notches 320.

The top stationary cam plate 240 and the bottom stationary cam plate 242 are substantially similar in construction in this example due to their similar functions and for ease of manufacturing. However, they can be constructed differently if desired. The top stationary cam plate 240 is generally circular in shape and includes a top clearance hole 258 formed at the center, aligned with the actuator tool access opening 230 and the actuator tool engagement portion 232 therebelow so that a tool can access the actuator tool engagement portion 232 being inserted through each of the actuator tool access opening 230 and the top clearance hole 258. The top stationary cam plate 240 further includes a top first linear pin slot 252, a top second linear pin slot 254, and a top third linear pin slot 256 formed through the top stationary cam plate 240 and arranged radially in an evenly spaced array about the center of the rotation C, and, in this example, the center of the circle. An opening 312 is formed at or near the edge 257 of the top stationary cam plate 240 for permitting insertion therethrough a ball-nose spring plunger 304. A weld nut 310 is welded to the top stationary cam plate 240 aligned with the opening 312, so that the ball-nose spring plunger 304 can be threaded into the weld nut 310 so that at least the ball-nose portion extends to and contacts the drive cam plate 244 below. The function of the ball-nose spring plunger 304 will be explained in greater detail below. The bottom stationary cam plate 242 includes a bottom first linear pin slot 260, a bottom second linear pin slot 262, and a bottom third linear pin slot 264 formed through the bottom stationary cam plate 242 and arranged radially in an evenly spaced array about the center of the rotation. The linear pin slots 252, 254, 256 of the top stationary cam plate 240 are substantially similar to and aligned with the linear pin slots 260, 262, 264 of the bottom stationary cam plate 242. Further, an optional bottom clearance hole 266 is formed through the center of the bottom stationary cam plate 242. Again, the bottom stationary cam plate 242 is similarly constructed to the top stationary cam plate 240 for ease of manufacturing, and may include similar features that serve no critical purpose when the component is used as a bottom stationary cam plate 242. In one or more embodiments, the bottom stationary cam plate 242 is optional and may be excluded. In one or more embodiments, there may be two opposed linear pin slots formed through the top stationary cam plate 240 and the bottom stationary cam plate 242, or four or more linear pin slots.

The drive cam plate 244 includes a first curved pin slot 268, a second curved pin slot 270, and a third curved pin slot 271, formed through the drive cam plate 244 spiraling generally outward from the center of rotation C. Each of the curved pin slots 268, 270, 271 are arranged and configured to each respectively intersect the corresponding linear pin slot 252, 254, 256 of the top stationary cam plate 240 (and, likewise, the corresponding linear pin slot 260, 262, 264 of the bottom stationary cam plate 242), such that at all points in the rotation of the drive cam plate 244, the curved pin slots 268, 270, 271 and the linear pin slots 252, 254, 256 (and 260, 262, 264) must cross paths at some portion along the lengths of the three trios of intersecting slots. As the drive cam plate 244 is rotated, the points of intersection move along both the linear and curved slots to form a first traveling intersection 322 at the dynamic intersection of the top first linear pin slot 252, the bottom first linear pin slot 260, and the first curved pin slot 268. A second traveling intersection 324 is dynamically formed at the dynamic intersection of the top second linear pin slot 254, the bottom second linear pin slot 262, and the second curved pin slot 270. And a third traveling intersection 326 is formed at the dynamic intersection of the top third linear pin slot 256, the bottom third linear pin slot 264, and the third curved pin slot 271.

The pin-in-slot cam linkage 238 includes a first rod 272, a second rod 274, and a third rod 276, each configured to travel radially from a retracted state to a deployed state. The first rod 272 includes a first piercing tip 278, a first elongated nock 284 extending axially through the first rod 272, and a first pin through hole 290 drilled transversely through the first rod 272 and across the first elongated nock 284. The second rod 274 includes a second piercing tip 280, a second elongated nock 286 extending axially through the second rod 274, and a second pin through hole 292 drilled transversely through the second rod 274 and across the second elongated nock 286. The third rod 276 includes a third piercing tip 282, a third elongated nock 288 extending axially through the third rod 276, and a third pin through hole 294 drilled transversely through the third rod 276 and across the third elongated nock 288.

When assembled, the edge 328 of the drive cam plate 244 is received into the first elongated nock 284 of the first rod 272 to position the first pin through hole 290 at the first traveling intersection 322. With the first pin through hole 290 aligned with the intersection of the top first linear pin slot 252, the bottom first linear pin slot 260, and the first curved pin slot 268, a first pin 296 is press fitted into the first pin through hole 290 of the first rod 272, with the first pin 296 capturing the first rod 272 to the first curved pin slot 268 and restricting travel of the first pin 296 to within the first curved pin slot 268. The first pin 296 protrudes from the first pin through hole 290 of the first rod 272, such that the top end of the first pin 296 is positioned and confined to travel within the top first linear pin slot 252, and the bottom end of the first pin 296 is positioned and confined to travel within the bottom first linear pin slot 260. Further, the first rod 272 extends through the first rod guide hole 314 of the first frame bracket 246, where the first rod 272 is permitted to freely slide in and out through the first rod guide hole 314, which acts to strengthen and guide the first rod 272 and to prevent undue slop (i.e., up and down movement) that may cause chatter and binding of the first rod 272.

Figure 10:
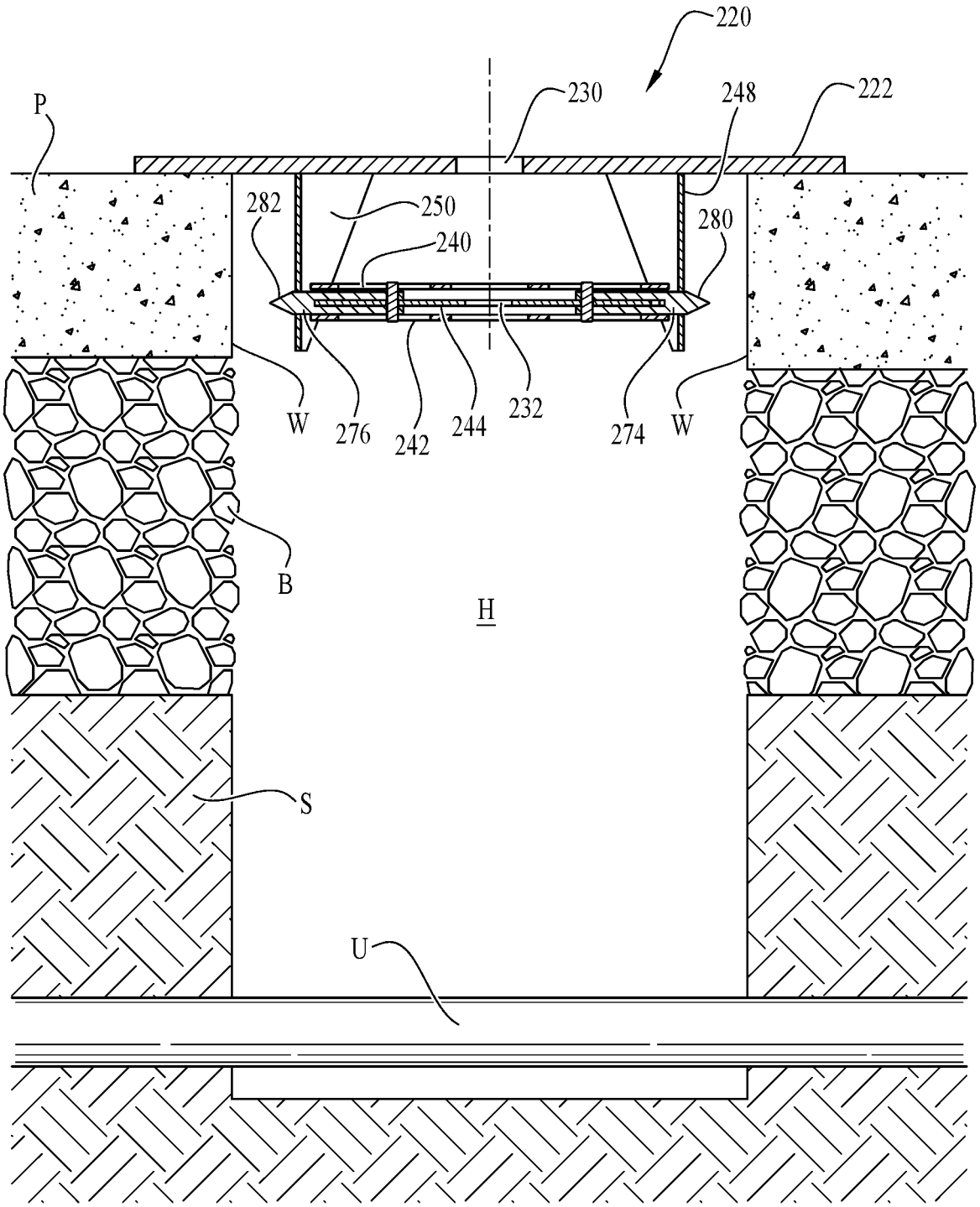
FIG. 10 is a side view of the anchored hole cover of FIG. 7, showing the anchored hole cover inserted within a bore hole formed through a paved surface in the unanchored configuration.
Figure 11:
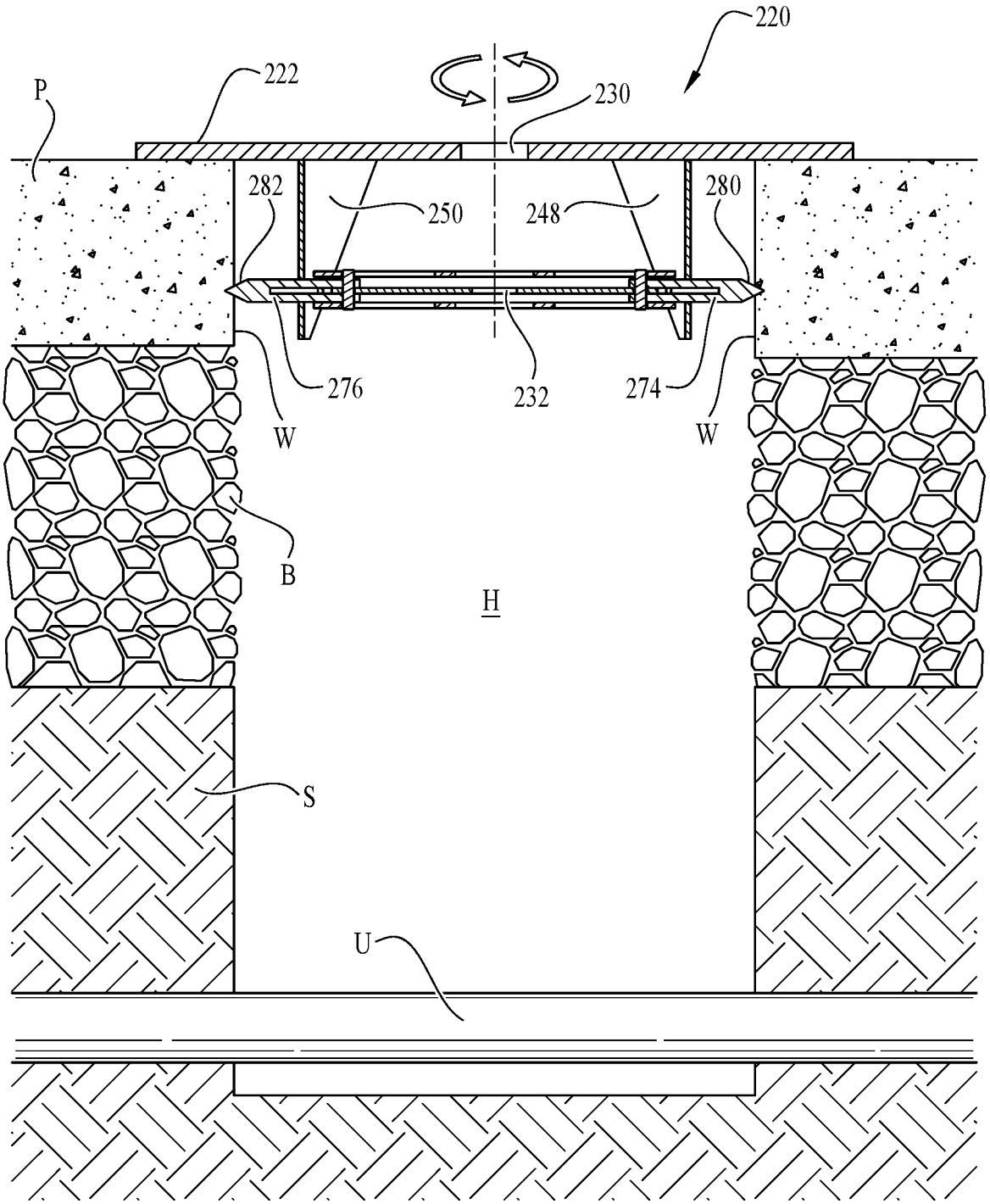
FIG. 11 is a side view of the anchored hole cover of FIG. 10, showing the anchored hole cover in the anchored configuration.
Figure 12:
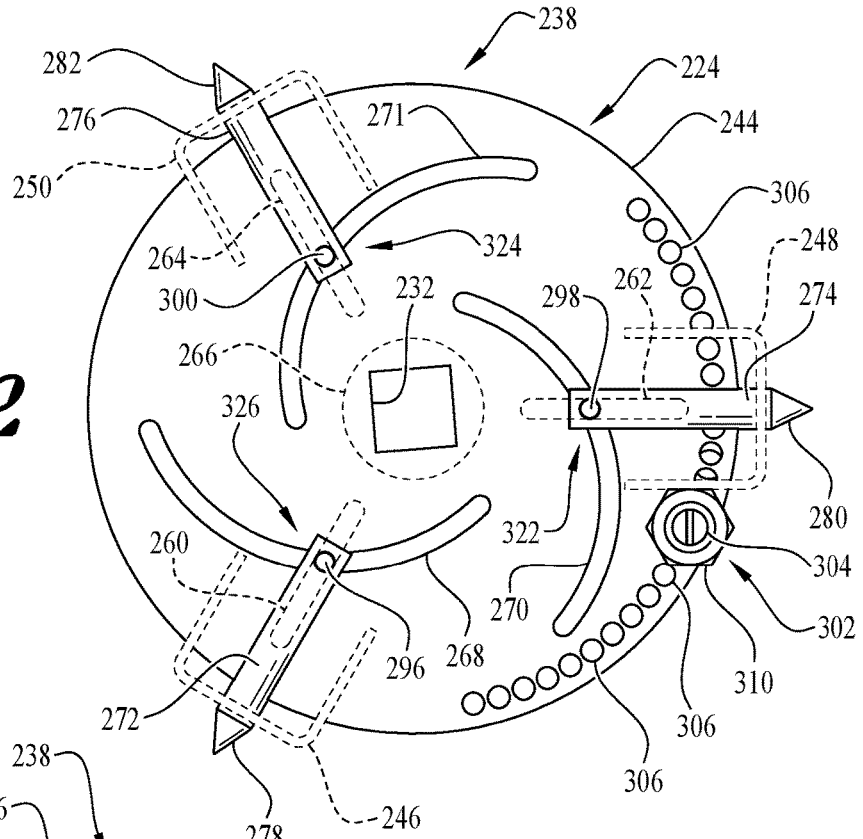
FIG. 12 is a bottom view of the anchored hole cover of FIG. 7, illustrating the pin-in-slot cam linkage in the unanchored configuration.
Figure 13:
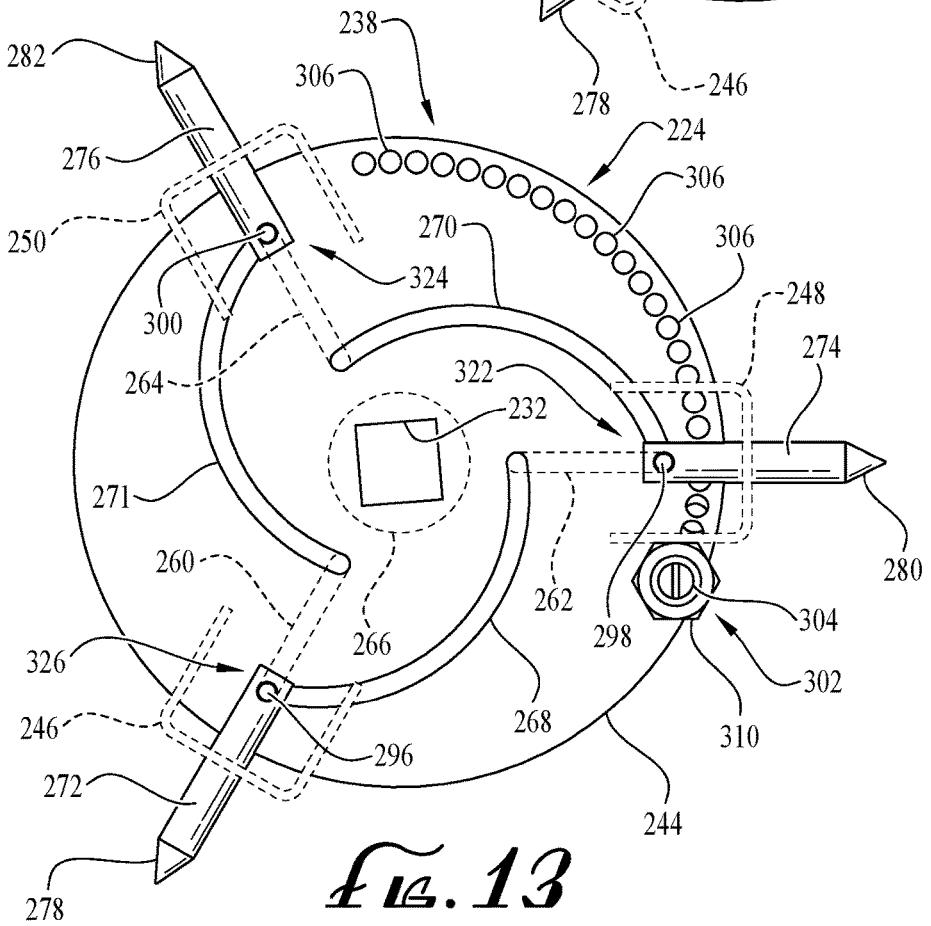
FIG. 13 is a bottom view of the anchored hole cover of FIG. 12, illustrating the pin-in-slot cam linkage in the anchored configuration.
Figure 14:
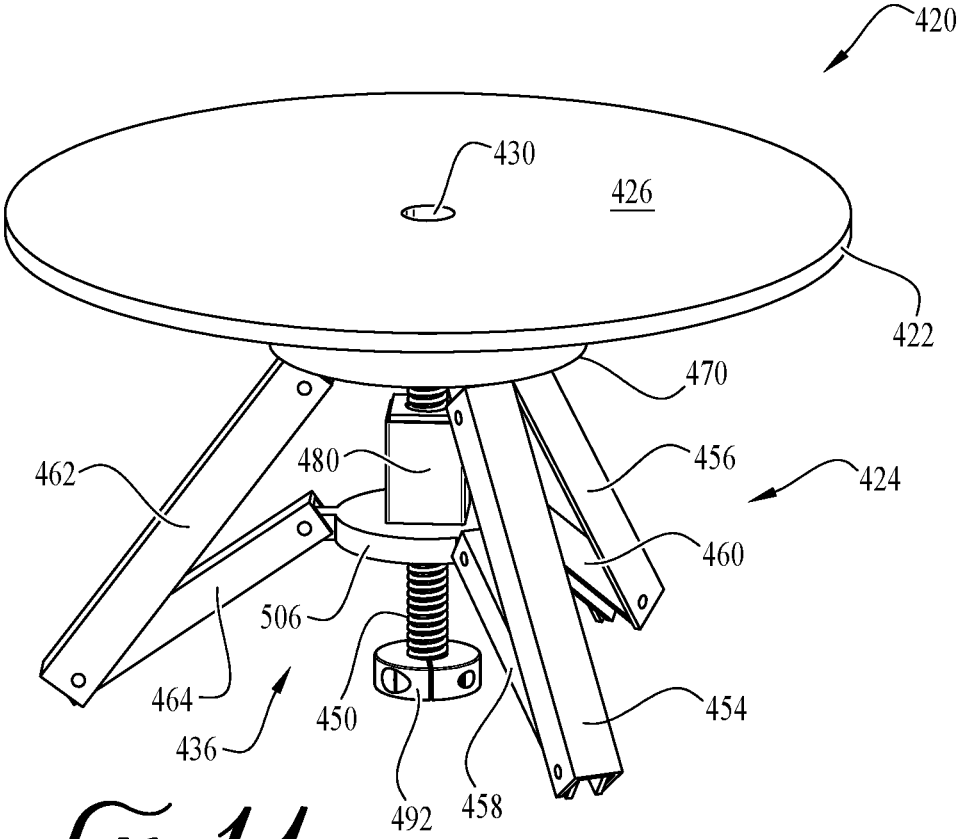
FIG. 14 is an assembled top perspective view of yet another exemplary embodiment of an anchored hole cover disclosed herein.
Figure 15:
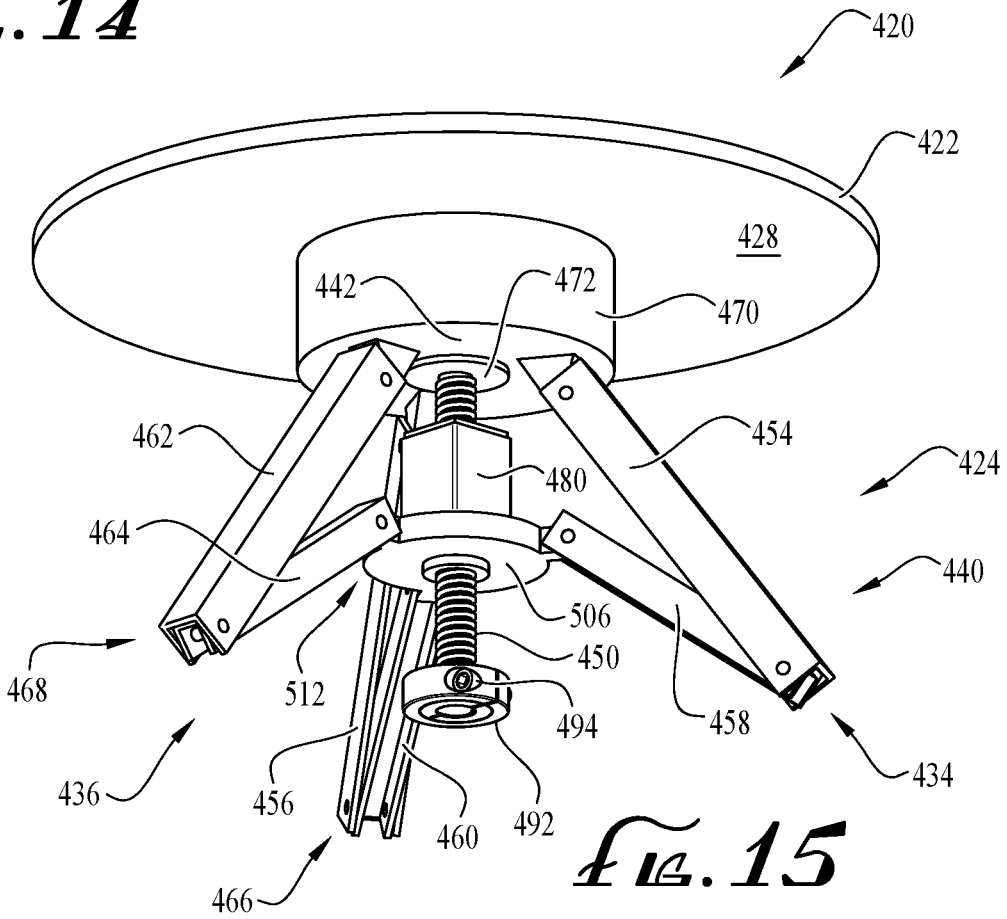
FIG. 15 is an assembled bottom perspective view of the anchored hole cover of FIG. 14.
Figure 16:
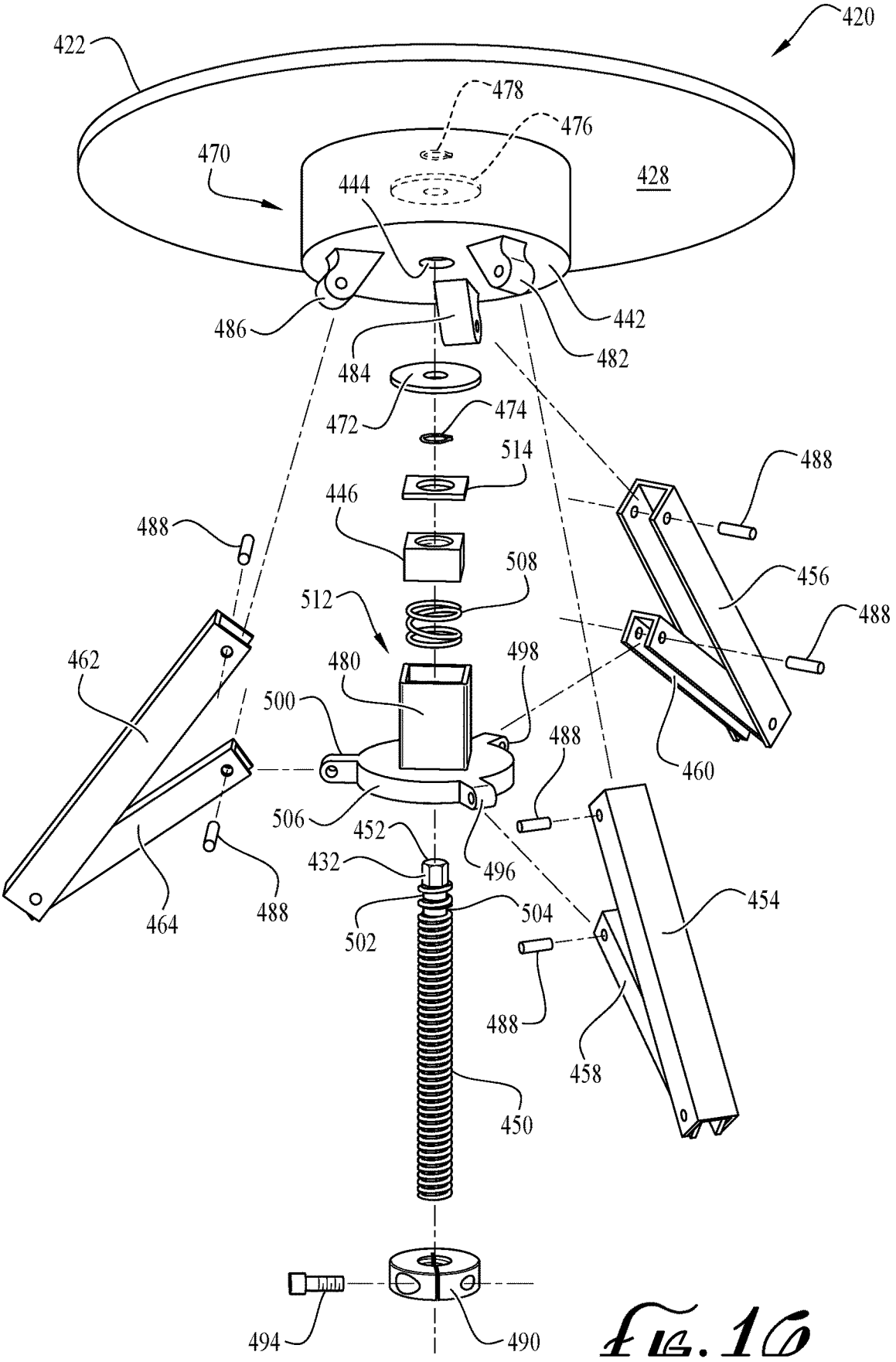
FIG. 16 is an exploded perspective view of the anchored hole cover of FIG. 14.

Initially, just looking at the travel of the first rod 272 which is similar to and representative of the travel of the remaining rods 274, 276, and also referring to FIGS. 12-13, when the first rod 272 is in the retracted configuration (as seen in FIG. 12), the first pin 296 is positioned within each of the top first linear pin slot 252, the bottom first linear pin slot 260, and the first curved pin slot 268 and located nearest to the center of rotation C for each slot. As the drive cam plate 244 in FIG. 12 is rotated counterclockwise (with the top stationary cam plate 240 and the bottom stationary cam plate 242 remaining stationary) the portion of the first curved pin slot 268 that intersects the top first linear pin slot 252 and the bottom first linear pin slot 260 changes from a portion nearer to the center of rotation C to a portion further from the center of rotation C. As the user rotates the drive cam plate 244, the first pin 272 is pushed outward by the cam-like action caused by the outwardly spiraling first curved pin slot 268. As a result, the first traveling intersection 322 moves through a linear path along the linear slots 252, 260 radially from nearer to the center of rotation C to further from the center of rotation C (as seen in FIG. 13), with the first piercing tip 278 being brought into engagement with the wall W of the bore hole H (as seen in FIG. 11). Turing the drive cam plate 244 in a clockwise direction will oppositely cause the first pin 272 to retract pulling the first piercing tip 278 out of engagement with the wall W of the bore hole H (as seen in FIG. 10).

As the drive cam plate 244 is rotated, a motion checking mechanism 302 discretely divides the rotational motion into small steps delineated by the action of the ball-nose spring plunger 304 successively engaging and disengaging with a series of detent holes 306 formed along an arcuate path and drilled through the drive cam plate 244 near the edge 328. The adjustment screw 308 of the ball-nose spring plunger 304 can be threaded in and out of the ball-nose spring plunger 304 to increase and decrease, respectively, the spring force of the ball of the ball-nose spring plunger 304. The ball portion of the ball-nose spring plunger 304 is configured to seat within one of the detent holes 306 and hold the position of the drive cam plate 244 relative to the top stationary cam plate 240. The spring force of the ball of the ball-nose spring plunger 304 should be adjusted to provide sufficient resistance to prevent disengagement of the ball once set within a particular detent hole 306, so that once the user rotates the rods 272, 274, 278 into engagement with the wall W of the bore hole H, the rods 272, 274, 278 are held in the engaged configuration and are not permitted to retract under the influence of various forces. However, the spring force of the ball of the ball-nose spring plunger 304 should not be set so great as to prevent rotation by the user applying a torque with a tool.

Referring now to FIGS. 14-20, yet another example embodiment of the present anchored hole cover 420 is illustrated, and generally includes a cover plate 422 with an anchoring mechanism 424 coupled thereto and extending from the bottom surface 428 of the cover plate 422. The anchoring mechanism 424 coverts a user torque input into radial or lateral expansion to grip, hook, and/or pierce the walls W of the bore hole H (as exemplified in FIGS. 17 & 18). The anchoring mechanism 424 general includes an actuator tool engagement portion 432 which is, in one or more embodiments, accessed by an actuator tool through an actuator tool access opening 430. The actuator tool engagement portion 432 is mechanically connected to the bore hole engagement portion 434 through a linkage system 436. Thus, upon actuation, the linkage system 436 amplifies the magnitude of the torque and/or converts the torque to generally or overall lateral movement of the bore hole engagement portion 432.

The actuator tool engagement portion 432 in this example embodiment is the head 454 of a drive screw 450; the linkage system 436 is a scissor linkage 440; and the bore hole engagement portions 434, 466, 468 are, in this example embodiment, the joints comprising the distal ends of each of the upper arms 454, 456, 462 and the distal ends of each of the lower arms 458, 460, 464, where each of the upper arms 454, 456, 462 are pivotally joined to their respective lower arms 458, 460, 464 at the distal ends. The bore hole engagement portions 434, 466, 468 are configured to move to engage and disengage the wall W of the bore hole H or some other portion of the bore hole H in response to the torque input. The present design can be made compatible with hooking extensions of the above-described embodiments (such as, e.g., hooking extensions 38, 39) with minor modifications.

In one or more embodiments, the scissor linkage 440 is comprised of a first upper arm 454, a second upper arm 456, and a third upper arm 462 each pivotally coupled at proximal ends to the trunnion plate 442 through the first upper pivot mount 482, the second upper pivot mount 484, and the third upper pivot mount 486, respectively, protruding from the trunnion plate 442 to permit the upper arms 454, 456, 462 to each rotate about its respective mount 482, 484, 486 about respective pins 488 from a first position with the distal ends of the upper arms 454, 456, 462 rotated closer to a longitudinal axis of the drive screw 450 to a second position with the distal ends of the upper arms 454, 456, 462 rotated further from the longitudinal axis of the drive screw 450.

In this example embodiment, the trunnion plate 442 is part of the anchoring mechanism support bracket 470 that extends from the bottom surface 428 of the cover plate 422 and generally comprises an annular sidewall 471 extending downwardly from the bottom surface 428 with the trunnion plate 442 welded or otherwise joined to the bottom edge of the annular sidewall 471 to define an interior space 521. A clearance hole 444 axially aligned with the actuator tool access opening 430 is provided through the trunnion plate 442 for receiving therethrough and supporting therein the drive screw 450.

The scissor linkage 440 is further comprises a first lower arm 458, a second lower arm 460, and a third lower arm 464 each pivotally coupled at proximal ends to the drive trunnion plate 506 through the first lower pivot mount 496, the second lower pivot mount 498, and the third lower pivot mount 500, respectively, protruding from the drive trunnion plate 506 to permit the lower arms 496, 498, 500 to each rotate about its respective mount 496, 498, 500, about respective pins 488, from a first position with the distal ends of the lower arms 496, 498, 500 rotated closer to a longitudinal axis of the drive screw 450 to a second position with the distal ends of the lower arms 496, 498, 500 rotated further from the longitudinal axis of the drive screw 450.

In one or more embodiments, the upper arms 454, 456, 462 and the lower arms 496, 498, 500 are made of a U-channel material (i.e., steel or other suitable material stock) where the arms are configured to nest at least partially. Here, U-channel of the upper arms 454, 456, 462 is larger than the U-channel of the lower arms 496, 498, 500, permitting the lower arms 496, 498, 500 to nest within the upper arms 454, 456, 462. This arrangement, in part, permits the scissor linkage 440 to fold to a more compact arrangement to fit in smaller holes H than the embodiments described above, yet expand sufficiently to fit within a hole slightly smaller in diameter than the cover plate 422. In this way, the present anchored hole cover 420 is able to fit within a larger range of hole H diameters compared to the above-described embodiments.

Figure 19:
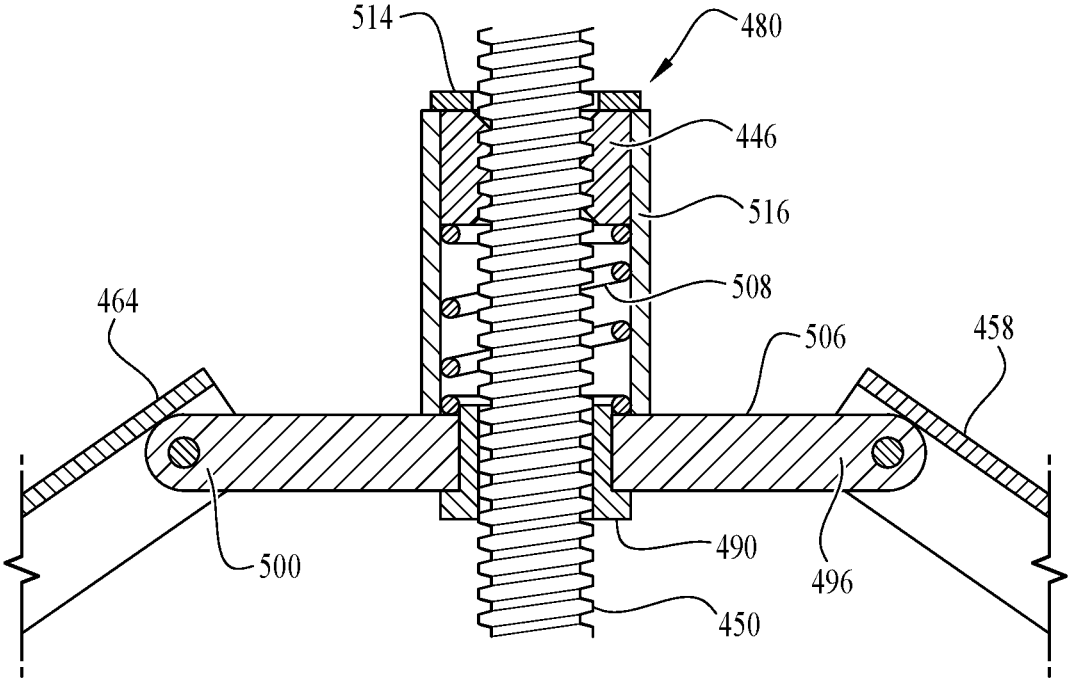
FIG. 19 is a magnified cross-sectional view of a linkage biasing system of the present anchored hole cover, illustrating the spring in an uncompressed or minimally compressed state.

The linkage biasing assembly 512, as illustrated in greater detail in FIGS. 19 and 20, comprises primarily drive trunnion plate 506 rigidly coupled to a biasing housing 480. The biasing housing 480 comprises a side wall 516 attached to the drive trunnion plate 506 by a bottom edge, with a top plate 514 attached to the top edge of the biasing housing 480 opposite the drive trunnion plate 506. A through hole 518 is formed through the top plate 518. Further, a through hole 491 is formed through the drive trunnion plate 506 and is lined with sleeve 490. Through holes 518 and 491 are aligned and configured to receive therethrough drive screw 450. The drive screw 450 extend through the biasing housing 480 and through a compression spring 508 (e.g., a coil spring in this example), with a drive trunnion 446 threaded onto the driveshaft 450 (through threaded hole 448) with the compression spring 508 captured and compressible between the bottom of the drive trunnion 446 and the drive trunnion plate 506. The outer profile of the drive trunnion 446 is shaped to prohibit substantial rotation of the drive trunnion 446 relative to the sidewall 516, yet permit axial travel along the longitudinal axis of the drive screw 450 as indicated by arrow 510. The outer profile of the drive trunnion 446 in this example is square, and is slightly smaller than the square inner wall profile of the sidewall 516 to permit axial translation and prohibit rotation of the drive trunnion 446. A stop or collar 492 fastened to the distal end of the drive screw 450 by screw 494 limits the travel of the linkage biasing system 512.

As the bore hole engagement portions 434, 466, 468 come into contact with (and/or pierce into) the bore hole wall W and the head 452 of the drive screw 450 is further tightened, the bore hole engagement portions 434, 466, 468 resist further deployment which halts or limits the axial travel of the drive trunnion plate 506. When the drive trunnion 446 translates a distance that is smaller than the axial advance distance of the drive trunnion 446, the drive trunnion 446 moves from a position near the top plate 514 (as seen in FIG. 19) towards the drive trunnion plate 506 (as seen in FIG. 20), compressing the compression spring 508. When the compression spring 508 is compressed, it asserts an outward bias on the lower arms 496, 498, 500, pushing them into engagement with the bore hole wall W. In this way, as the anchored hole cover 420 is jostled during normal use, causing the bore hole engagement portions 434, 466, 468 to shift in relation to the bore hole wall W, the linkage biasing assembly 512 will force the bore hole engagement portions 434, 466, 468 back into engagement or maintain the bore hole engagement portions 434, 466, 468 in engagement.

The head 452 of the drive screw 450 is inserted through the clearance hole 444 formed through the trunnion plate 442 of the anchoring mechanism support bracket 470, and is held in place within the clearance hole 444 by the top retaining ring 478 resting atop the top washer 476 with the top retaining ring 478 locked into retaining groove 502. The drive screw 450 is further held in place within the clearance hole 444 by the bottom retaining ring 474 positioned below the bottom washer 472 with the bottom retaining ring 474 locked into retaining groove 504. This prevents substantial axial movement and permits rotational movement of the drive screw 450 relative to the trunnion plate 442 and maintains the head 452 within the interior space 521 of the anchoring mechanism support bracket 470.

Figure 17:
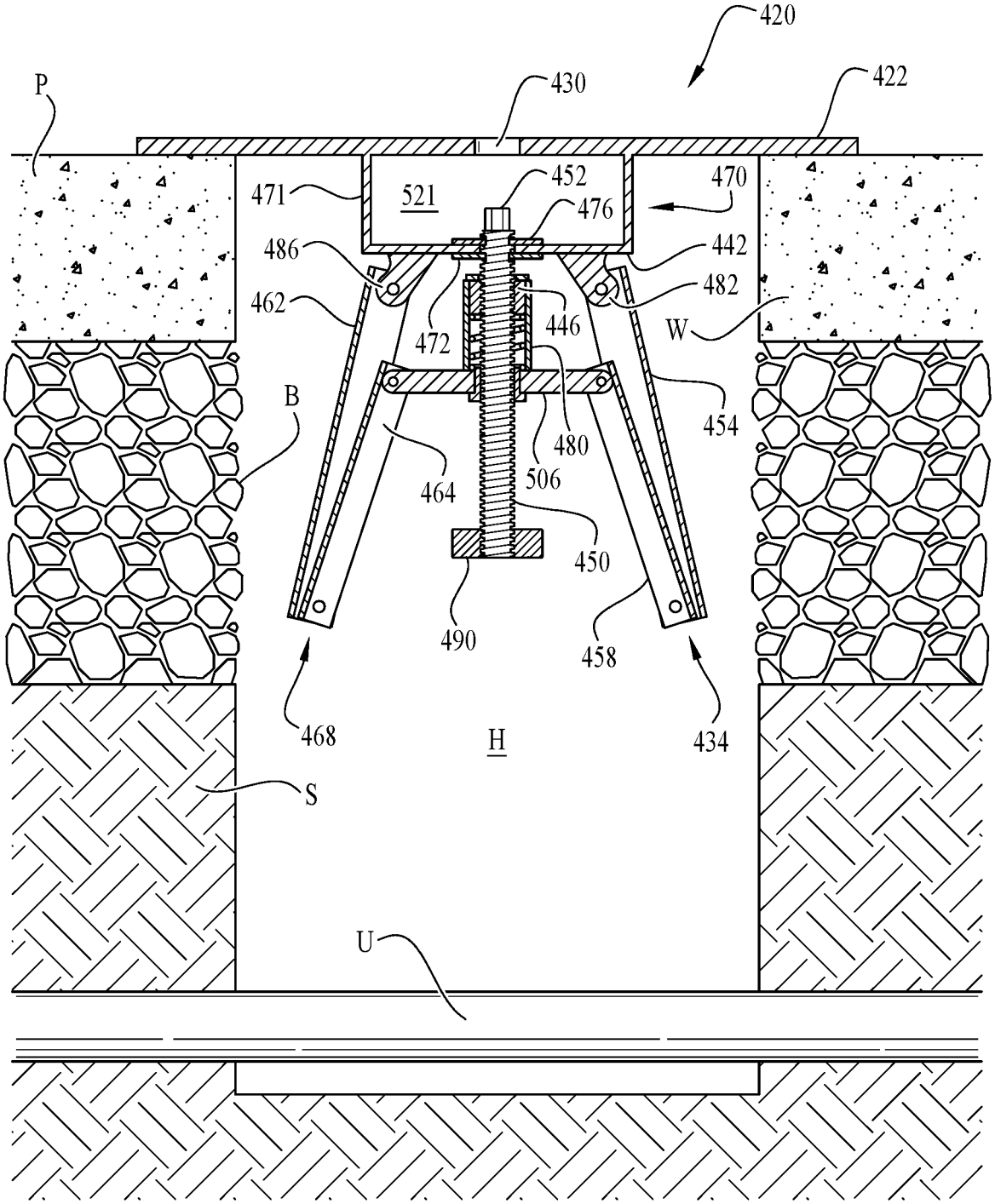
FIG. 17 is a side view of the anchored hole cover of FIG. 14, showing the anchored hole cover inserted within a bore hole formed through a paved surface in the unanchored configuration.
Figure 18:
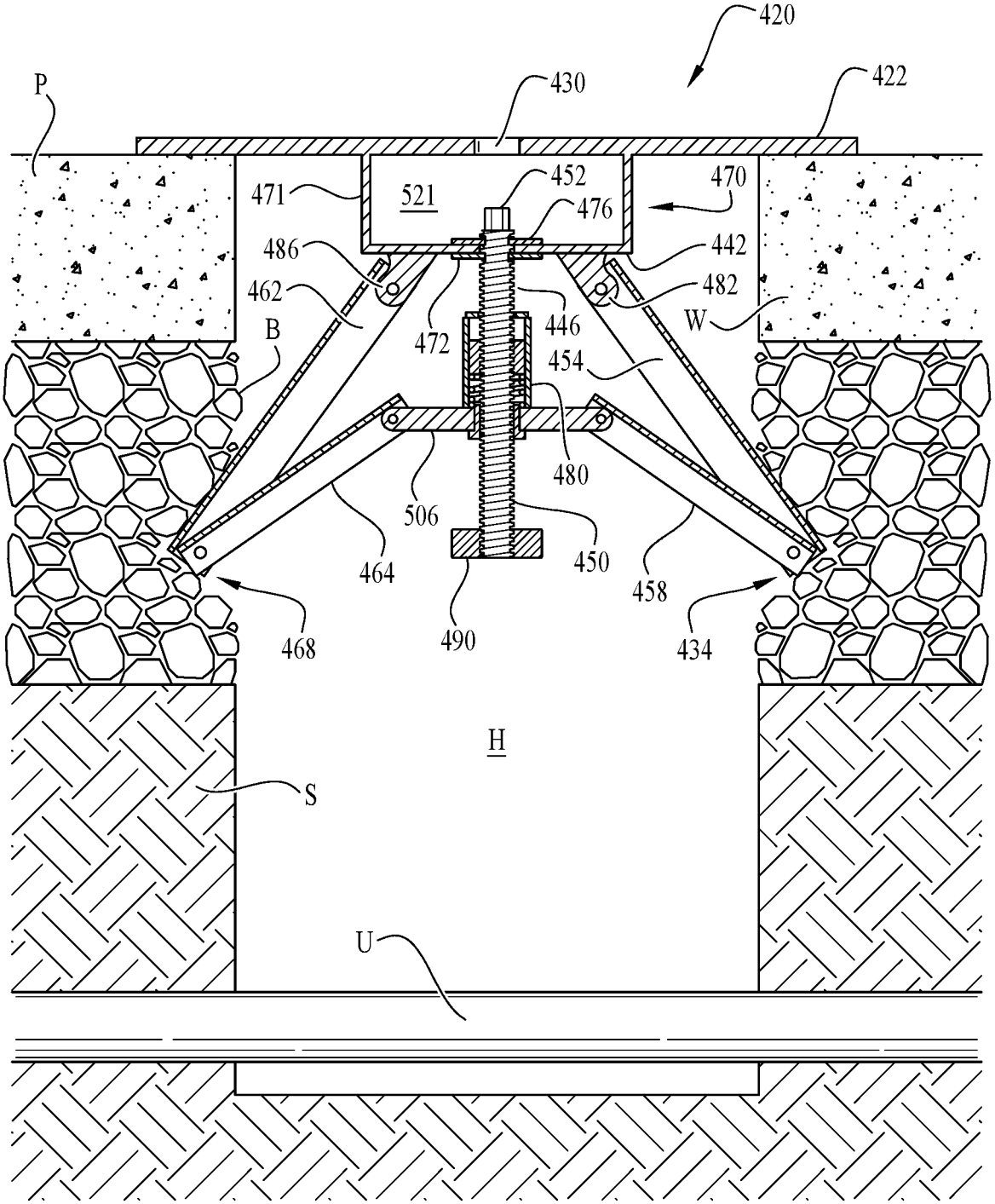
FIG. 18 is a side view of the anchored hole cover of FIG. 17, showing the anchored hole cover in the anchored configuration.

In use, referring to FIGS. 17 and 18, the user inserts the anchoring mechanism 424 of the anchored hole cover 420 (in a folded or compact configuration) into the bore hole B, with the cover plate 422 resting on the pavement P about the bore hole B. An actuator tool (not illustrated, but known in industry) is inserted through access hole 430 and engaged to the head 452 of the drive screw 450. A torque is applied to the actuator tool to turn the drive screw 450 and force the drive trunnion 446 and the entire linkage biasing system 512 down the length of the drive screw 450, thus forcing the scissor linkage 440 outwards until coming into contact with the bore hole wall W. With additional tightening, the bore hole engagement portions 434, 466, 468 are forced into further engagement with the wall W sufficient to prevent inadvertent removal of the anchored hole cover 420 (under normal operating conditions) from the bore hole H. While tightening, the drive trunnion 446 compresses the spring 508 to outwardly bias the bore hole engagement portions 434, 466, 468 into engagement with the wall W. Removal is the reversal of the above process, where the drive trunnion 446 first moves toward the top plate 514 (and is prohibited from further upward travel) to permit the spring 508 to expand such that there is no longer a substantial spring bias on the scissor linkage 440. After the scissor linkage 440 is folded, such that the bore hole engagement portions 434, 466, 468 are disengaged with the wall W, the user can remove the anchored hole cover 420 from the bore hole H.

As discussed above in relation to the example embodiment of FIGS. 1-6, the piercing tips 278, 280, 282 are just one form of bore hole engagement portions, and can be changed as required by the application to a hooking extension, a frictional engagement extension, or other forms of anchors.

In one or more example embodiments, the cover plate 22 is made of steel plate material sufficiently strong and thick to support heavy vehicular traffic thereupon. The weight bearing capacity of the cover plate 22 is up to 10,000 pounds, or up to 20,000 pounds, or up to 30,000 pounds, or up to 40,000 pounds, or up to 50,000 pounds, or up to 60,000 pounds, or up to 70,000 pounds, or up to 80,000 pounds, or up to 90,000 pounds, or up to or exceeding 100,000 pounds.

In one or more example embodiments, the anchoring mechanism 24 is sufficiently strong to resist an extraction force up to 1,000 pounds, or up to 3,000 pounds, or up to 5,000 pounds, or up to 7,000 pounds, or up to or exceeding 10,000 pounds.

Aspects of the present specification may also be described by the following embodiments:

1. An anchored hole cover for covering a bore hole formed through a paved surface, the anchored hole cover comprising a cover plate having a top surface and a bottom surface opposite the top surface, the top surface being configured to support safe passage of pedestrians and vehicular traffic across the anchored hole cover; an anchoring mechanism having an actuator tool engagement portion mechanically connected to a bore hole engagement portion through a linkage system, the anchoring mechanism being coupled with the cover plate and extending from the bottom surface of the cover plate; and a linkage biasing mechanism having a spring element that biases the linkage system radially outward when the spring element is deflected; wherein, during an insertion procedure, the anchoring mechanism is configured to be positioned within the bore hole and supported at least initially therein by the cover plate that is configured to rest upon the paved surface and substantially cover the bore hole; and wherein, during a fastening procedure, the actuator tool engagement portion of the anchoring mechanism is configured to be actuated to cause a first movement through the linkage system to move the bore hole engagement portion into anchoring contact with the bore hole and to deflect the spring element to substantially prevent extraction of the anchoring mechanism from the bore hole and to substantially prevent lifting of the cover plate due to forces exerted by vehicular traffic thereupon.
2. The anchored hole cover of embodiment 1, wherein, during an unfastening procedure, the actuator tool engagement portion of the anchoring mechanism is configured to be actuated to cause a second movement through the linkage system to pull the bore hole engagement portion out of anchoring contact with the bore hole and to release the spring element to permit extraction of the anchoring mechanism from the bore hole.
3. The anchored hole cover of embodiments 1 or 2, wherein actuation comprises rotation of the actuator tool engagement portion in a first rotational direction to cause the first movement and rotation of the actuator tool engagement portion in a second rotational direction opposite the first rotational direction to cause the second movement.
4. The anchored hole cover of any one of embodiments 1-3, wherein the cover plate further comprises an actuator tool access opening, the actuator tool engagement portion being situated substantially flush or below the top surface of the cover plate and sufficiently aligned with the actuator tool access opening to permit actuation of the actuator tool engagement portion through the actuator tool access opening.
5. The anchored hole cover of any one of embodiments 1-4, wherein the linkage biasing mechanism further comprises a housing configured to receive therethrough a drive screw with a drive trunnion threadably coupled thereon, the spring element and a drive trunnion being captured within the housing, the housing prohibits rotational movement of the drive trunnion and permits axial movement of the drive trunnion along the drive screw within the housing as the drive screw is rotated, the spring element being compressed by the drive trunnion during the first movement through the linkage system.
6. The anchored hole cover of any one of embodiments 1-5, wherein the linkage biasing mechanism further comprises a drive trunnion plate through which the drive screw passes, the spring element being compressed between the drive trunnion and the drive trunnion plate.
7. The anchored hole cover of any one of embodiments 1-6, wherein the linkage system of the anchoring mechanism is a scissor linkage, the drive screw is coupled to and extends downward through a clearance hole formed through a trunnion plate of an anchoring mechanism support bracket extending from the bottom surface of the top plate, wherein rotation of the head of the drive screw in a first rotational direction causes the drive trunnion to move toward the trunnion plate to move the bore hole engagement portion into anchoring contact with the bore hole.

8. The anchored hole cover of any one of embodiments 1-7, wherein the scissor linkage further comprises a first upper arm pivotally coupled to the trunnion plate by a first upper arm upper end and a first lower arm pivotally coupled by a first lower arm upper end to a first upper arm lower end to form the bore hole engagement portion, a first lower arm lower end being pivotally coupled to the trunnion plate; and a second upper arm pivotally coupled to the trunnion plate by a second upper arm upper end and a second lower arm pivotally coupled by a second lower arm upper end to a second upper arm lower end to form the second bore hole engagement portion, a second lower arm lower end being pivotally coupled to the trunnion plate.
9. The anchored hole cover of any one of embodiments 1-8, wherein the scissor linkage further comprises a third upper arm pivotally coupled to the trunnion plate by a third upper arm upper end and a third lower arm pivotally coupled by a third lower arm upper end to a third upper arm lower end to form the third bore hole engagement portion, a third lower arm lower end being pivotally coupled to the trunnion plate.
10. The anchored hole cover of any one of embodiments 1-9, further comprising an anchoring mechanism support bracket extending from the bottom surface of the top plate, the anchoring mechanism support bracket having a trunnion plate with a clearance hole formed therethrough, an interior space of the anchoring mechanism support bracket being defined at least partially between the bottom surface of the top plate and the trunnion plate; and a drive screw coupled to and extending downward through the clearance hole of the trunnion plate, the actuator tool engagement portion is the head of the drive screw, the drive screw being supported such that the head is positioned within the interior space and such that the drive screw is permitted to rotate about a longitudinal axis thereof.
11. The anchored hole cover of any one of embodiments 1-10, wherein the drive screw includes a retaining groove proximal to the head where the retaining groove is positioned within the interior space and receives therein a retaining ring rotatably supporting the drive screw extending therebelow.
12. The anchored hole cover of any one of embodiments 1-11, wherein a stop at the distal end of the drive screw limits the axial travel of the linkage biasing system.
13. The anchored hole cover of any one of embodiments 1-12, wherein the linkage biasing system biases the linkage system such that anchoring contact with the bore hole is maintained by the bore hole engagement portion.
14. The anchored hole cover of any one of embodiments 1-13, wherein the first upper arm and the first lower arm are nestable, and the second upper arm and the second lower arm are nestable.
15. An anchored hole cover for covering a bore hole formed through a paved surface, the anchored hole cover comprising a cover plate having a top surface and a bottom surface opposite the top surface, the top surface being configured to support safe passage of pedestrians and vehicular traffic across the anchored hole cover; an anchoring mechanism having an actuator tool engagement portion mechanically connected to a bore hole engagement portion through a linkage system with a drive screw, the anchoring mechanism being coupled with the cover plate and extending from the bottom surface of the cover plate; and a linkage biasing mechanism having a housing receiving therethrough the drive screw with a drive trunnion threadably coupled thereon, a spring element and drive trunnion being captured within the housing, the housing prohibiting rotational movement and permitting axial movement of the drive trunnion along the drive screw within the housing as the drive screw is rotated, the spring element being compressed by the drive trunnion during a first movement through the linkage system to bias the bore hole engagement portion radially outward; wherein, during an insertion procedure, the anchoring mechanism is configured to be positioned within the bore hole and supported at least initially therein by the cover plate that is configured to rest upon the paved surface and substantially cover the bore hole; and wherein, during a fastening procedure, the actuator tool engagement portion of the anchoring mechanism is configured to be actuated to cause the first movement through the linkage system to move the bore hole engagement portion into anchoring contact with the bore hole and to deflect the spring element to substantially prevent extraction of the anchoring mechanism from the bore hole and to substantially prevent lifting of the cover plate due to forces exerted by vehicular traffic thereupon.
16. The anchored hole cover of the embodiment 15, wherein the linkage system of the anchoring mechanism is a scissor linkage, the drive screw is coupled to and extends downward through a clearance hole formed through a trunnion plate of an anchoring mechanism support bracket extending from the bottom surface of the top plate, wherein rotation of the drive screw in a first rotational direction causes the drive trunnion to move toward the trunnion plate to move the bore hole engagement portion into anchoring contact with the bore hole.
17. The anchored hole cover of embodiments 15 or 16, wherein the scissor linkage further comprises a first upper arm pivotally coupled to the trunnion plate by a first upper arm upper end and a first lower arm pivotally coupled by a first lower arm upper end to a first upper arm lower end to form the bore hole engagement portion, a first lower arm lower end being pivotally coupled to the trunnion plate; and a second upper arm pivotally coupled to the trunnion plate by a second upper arm upper end and a second lower arm pivotally coupled by a second lower arm upper end to a second upper arm lower end to form the second bore hole engagement portion, a second lower arm lower end being pivotally coupled to the trunnion plate.
18. The anchored hole cover of any one of embodiments 15-17, wherein the scissor linkage further comprises a third upper arm pivotally coupled to the trunnion plate by a third upper arm upper end and a third lower arm pivotally coupled by a third lower arm upper end to a third upper arm lower end to form the third bore hole engagement portion, a third lower arm lower end being pivotally coupled to the trunnion plate.
19. The anchored hole cover of any one of embodiments 15-18, further comprising an anchoring mechanism support bracket extending from the bottom surface of the top plate, the anchoring mechanism support bracket having a trunnion plate with a clearance hole formed therethrough, an interior space of the anchoring mechanism support bracket being defined at least partially between the bottom surface of the top plate and the trunnion plate; and the drive screw being coupled to and extending downward through the clearance hole of the trunnion plate, the actuator tool engagement portion is a head of the drive screw, the drive screw being supported such that the head is positioned within the interior space and such that the drive screw is permitted to rotate about a longitudinal axis thereof.

20. The anchored hole cover of any one of embodiments 15-19, wherein the drive screw includes a retaining groove proximal to the head where the retaining groove is positioned within the interior space and receives therein a retaining ring rotatably supporting the drive screw extending therebelow.

21. An anchored hole cover for covering a bore hole formed through a paved surface, the anchored hole cover comprising a cover plate having a top surface, a bottom surface opposite the top surface, and an actuator tool access opening formed through the cover plate; an anchoring mechanism having an actuator tool engagement portion mechanically connected to a bore hole engagement portion through a linkage system, the actuator tool engagement portion being situated substantially flush or below the top surface of the cover plate and sufficiently aligned with the actuator tool access opening to permit actuation of the actuator tool engagement portion through the actuator tool access opening, the anchoring mechanism being coupled with the cover plate and extending from the bottom surface of the cover plate; wherein, during an insertion procedure, the anchoring mechanism is configured to be positioned within the bore hole and supported at least initially therein by the cover plate that is configured to rest upon the paved surface and substantially cover the bore hole; and wherein, during a fastening procedure, the actuator tool engagement portion of the anchoring mechanism is configured to be actuated to cause a first movement through the linkage system to move the bore hole engagement portion into anchoring contact with the bore hole to substantially prevent extraction of the anchoring mechanism from the bore hole and to substantially prevent lifting of the cover plate due to forces exerted by vehicular traffic thereupon.

22. The anchored hole cover of embodiment 21, wherein during an unfastening procedure, the actuator tool engagement portion of the anchoring mechanism is configured to be actuated to cause a second movement through the linkage system to move the bore hole engagement portion out of anchoring contact with the bore hole to permit extraction of the anchoring mechanism from the bore hole.

23. The anchored hole cover of embodiments 21 or 22, wherein actuation comprises rotation of the actuator tool engagement portion in a first rotational direction to cause the first movement and rotation of the actuator tool engagement portion in a second rotational direction opposite the first rotational direction to cause the second movement.

24. The anchored hole cover of any one of embodiments 21-23, wherein the bore hole engagement portion of the anchoring mechanism comprises a hooking extension protruding laterally from the anchoring mechanism and is configured to hook the pavement from underneath such that the extension extends beyond a bore hole wall to substantially prevent extraction of the anchoring mechanism.

25. The anchored hole cover of any one of embodiments 21-24, wherein the bore hole engagement portion of the anchoring mechanism comprises a piercing extension protruding laterally from the anchoring mechanism and is configured to pierce into a bore hole wall to substantially prevent extraction of the anchoring mechanism.

26. The anchored hole cover of any one of embodiments 21-25, wherein the bore hole engagement portion of the anchoring mechanism comprises a frictional engagement extension protruding laterally from the anchoring mechanism and is configured to frictionally engage a bore hole wall to substantially prevent extraction of the anchoring mechanism.

27. The anchored hole cover of any one of embodiments 21-26, wherein the linkage system of the anchoring mechanism is a scissor linkage and the actuator tool engagement portion is a head of a drive screw, the drive screw is coupled to and extends downward from the cover plate through a clearance hole formed through a stationary trunnion proximate the top plate and threaded through a threaded hole formed through a drive trunnion below the stationary trunnion, wherein rotation of the head of the drive screw in a first rotational direction causes the drive trunnion to move toward the stationary trunnion to move the bore hole engagement portion into anchoring contact with the bore hole.

28. The anchored hole cover of any one of embodiments 21-27, wherein the scissor linkage further comprises a first upper arm pivotally coupled to a second upper arm through the stationary trunnion, a first lower arm pivotally coupled to a second lower arm through the drive trunnion, a first engagement bracket pivotally coupling the first upper arm to the first lower arm, and a second engagement bracket pivotally coupling the second upper arm to the second lower arm, the first engagement bracket configured with the bore hole engagement portion, the second engagement bracket configured with a second bore hole engagement portion, wherein, when the drive trunnion is moved toward the stationary trunnion, the first engagement bracket and the second engagement bracket are forced away from one another to move the bore hole engagement portion and the second bore hole engagement portion into anchoring contact with the bore hole.

29. The anchored hole cover of any one of embodiments 21-28, further comprising a twist lock mechanism configured to connect the scissor mechanism to the cover plate and prevent rotation of the scissor mechanism, excluding the drive screw, relative to the cover plate as the drive screw is actuated, the twist lock mechanism comprising an anchoring mechanism support bracket attached to and extending from the bottom surface of the cover plate, a locking socket is formed through the anchoring mechanism support bracket with the locking socket aligned with the actuator tool access opening of the cover plate; a locking plate is located on the stationary trunnion with the clearance hole formed through the locking plate and a trunnion body of the stationary trunnion with a retaining groove formed between the trunnion body and the locking plate; and a retaining washer with a retaining socket formed therethrough, the retaining socket being configured to selectively align with the locking socket to permit the locking plate to be inserted through the locking socket and into the retaining socket, the retaining washer and the retaining socket being configured to be selectively rotated out of alignment with the locking socket such that the locking plate is not permitted to be withdrawn from the locking socket.

30. The anchored hole cover of any one of embodiments 21-29, wherein the locking socket, the locking plate, and the retaining socket are rectangular, and the locking plate is sized to fit through the locking socket and the locking plate when aligned.

31. The anchored hole cover of any one of embodiments 21-30, wherein the anchoring mechanism support bracket comprises a support plate with a sidewall extending upward therefrom with a top edge of the sidewall being attached to the bottom surface of the cover plate, the locking socket is formed through the support plate.

32. The anchored hole cover of any one of embodiments 21-31, wherein a retaining washer locating feature is formed adjacent to the locking socket of the anchoring mechanism support bracket and is configured to couple with a locating feature of the retaining plate to maintain the rotational position of the retaining washer.

33. The anchored hole cover of any one of embodiments 21-32, wherein, when the locking plate is inserted through the locking socket, the locking plate rests within the retaining socket and rotates with the retaining socket such that, when the retaining socket is rotated out of alignment with the locking socket, the locking plate is similarly out of alignment, with the retaining plate locking feature coupled with the locking feature of the retaining plate and with a locking socket edge portion located within the retaining groove such that the retaining plate holds the locking plate out of alignment with the locking socket with the scissor linkage being supported by the locking socket edge portion through the locking plate.

34. The anchored hole cover of any one of embodiments 21-33, wherein the linkage system of the anchoring mechanism is a pin-in-slot cam linkage comprising a stationary cam plate firmly attached to a frame extending downward from the cover plate to hold the position of the stationary cam plate relative to the cover plate, the stationary cam plate having a first linear pin slot and a second linear pin slot each formed therethrough and extending radially; a drive cam plate including the actuator tool engagement portion positioned at a center of rotation, the drive cam plate being rotatably coupled to the frame and configured to rotated relative to the stationary cam plate, the drive cam plate having a first curved pin slot and a second curved pin slot each formed therethrough and spiralling generally outward from the center of rotation, the first pin slot being configured to intersect the first linear pin slot at a first traveling intersection and the second pin slot being configured to intersect the second linear pin slot at a second traveling intersection; a first pin being coupled to the bore hole engagement portion, the first pin positioned and restricted to movement within both the first linear pin slot of the stationary cam plate and the first curved pin slot of the drive cam plate at the first traveling intersection; and a second pin being coupled to a second bore hole engagement portion, the second pin positioned and restricted to movement within both the second linear pin slot of the stationary cam plate and the second curved pin slot of the drive cam plate at the second traveling intersection; wherein rotation of the of the drive cam plate through the actuator tool engagement portion in a first rotational direction causes the first traveling intersection to move radially outwards along the first linear pin slot which causes the first pin to be pushed linearly outward within the first linear pin slot and carrying the bore hole engagement portion into anchoring contact with the bore hole, and causes the second traveling intersection to move radially outwards along the second linear pin slot which causes the second pin to be pushed linearly outward within the second linear pin slot and carrying the second bore hole engagement portion into anchoring contact with the bore hole.

35. The anchored hole cover of any one of embodiments 21-34, further comprising a second stationary cam plate having a third linear pin slot and a fourth linear pin slot each formed therethrough and extending radially, the third linear pin slot being substantially similar to and aligned with the first linear pin slot of the stationary cam plate, the fourth linear pin slot being substantially similar to and aligned with the second linear pin slot of the stationary cam plate, the first pin is configured to be positioned and restricted to movement within each of the first linear pin slot of the stationary cam plate, the first curved pin slot of the drive cam plate, and the third linear pin slot of the second stationary cam plate, and the second pin is configured to be positioned and restricted to movement within each of the second linear pin slot of the stationary cam plate, the second curved pin slot of the drive cam plate, and the fourth linear pin slot of the second stationary cam plate.

36. The anchored hole cover of any one of embodiments 21-35, wherein the bore hole engagement portion comprises a first rod having a first piercing tip, a first elongated nock formed opposite the piercing tip, and a first pin through hole drilled transversely through the first rod and across the first elongated nock, the first elongated nock configured to have inserted therewithin a first edge portion of the drive cam plate, the first pin through hole configured to receive therewithin the first pin further inserted through each of the first linear pin slot of the stationary cam plate, the first curved pin slot of the drive cam plate, and the third linear pin slot of the second stationary cam plate; and the second bore hole engagement portion comprises a second rod having a second piercing tip, a second elongated nock formed opposite the second piercing tip, and a second pin through hole drilled transversely through the second rod and across the second elongated nock, the second elongated nock configured to have inserted therewithin a second edge portion of the drive cam plate, the second pin through hole configured to receive therewithin the second pin further inserted through each of the second linear pin slot of the stationary cam plate, the second curved pin slot of the drive cam plate, and the fourth linear pin slot of the second stationary cam plate.

37. The anchored hole cover of any one of embodiments 21-36, wherein a third bore hole engagement portion comprises a third rod having a third piercing tip, a third elongated nock formed opposite the third piercing tip, and a third pin through hole drilled transversely through the third rod and across the third elongated nock, the third elongated nock configured to have inserted therewithin a third edge portion of the drive cam plate, the third pin through hole configured to receive therewithin a third pin further inserted through each of a fifth linear pin slot of the stationary cam plate, the third curved pin slot of the drive cam plate, and a sixth linear pin slot of the second stationary cam plate.

38. The anchored hole cover of any one of embodiments 21-37, wherein the drive cam plate is positioned between the stationary cam plate and the second stationary cam plate in a stacked arrangement, a spacing between the stationary cam plate and the second stationary cam plate being sufficient to permit movement therebetween of the first pin and the second pin.

39. The anchored hole cover of any one of embodiments 21-38, wherein a framework comprising a plurality of brackets extend downward from the bottom surface of the cover plate and is configured to hold the stacked arrangement by preventing rotation of the stationary cam plate and the second stationary cam plate, yet permitting rotation of the drive cam plate.

40. The anchored hole cover of any one of embodiments 21-39, wherein the plurality of bracket comprise a first bracket configured to hold a first portion of the stacked arrangement and a second bracket configured to hold a second portion of the stacked arrangement, the first bracket having a first rod guide configured to slidably receive therewithin the first rod, the second bracket having a second rod guide configured to slidably receive therewithin the second rod.

41. The anchored hole cover of any one of embodiments 21-40, wherein the drive cam plate is selectively prevented from rotating relative to the stationary cam plate by a motion checking mechanism to prevent unintentional retraction of the bore hole engagement portion and the second bore hole engagement portion.

In closing, foregoing descriptions of embodiments of the present invention have been presented for the purposes of illustration and description. It is to be understood that, although aspects of the present invention are highlighted by referring to specific embodiments, one skilled in the art will readily appreciate that these described embodiments are only illustrative of the principles comprising the present invention. As such, the specific embodiments are not intended to be exhaustive or to limit the invention to the precise forms disclosed. Therefore, it should be understood that embodiments of the disclosed subject matter are in no way limited to a particular element, compound, composition, component, article, apparatus, methodology, use, protocol, step, and/or limitation described herein, unless expressly stated as such.

In addition, groupings of alternative embodiments, elements, steps and/or limitations of the present invention are not to be construed as limitations. Each such grouping may be referred to and claimed individually or in any combination with other groupings disclosed herein. It is anticipated that one or more alternative embodiments, elements, steps and/or limitations of a grouping may be included in, or deleted from, the grouping for reasons of convenience and/or patentability. When any such inclusion or deletion occurs, the specification is deemed to contain the grouping as modified, thus fulfilling the written description of all Markush groups used in the appended claims.

Furthermore, those of ordinary skill in the art will recognize that certain changes, modifications, permutations, alterations, additions, subtractions and sub-combinations thereof can be made in accordance with the teachings herein without departing from the spirit of the present invention. Furthermore, it is intended that the following appended claims and claims hereafter introduced are interpreted to include all such changes, modifications, permutations, alterations, additions, subtractions and sub-combinations as are within their true spirit and scope. Accordingly, the scope of the present invention is not to be limited to that precisely as shown and described by this specification.

Certain embodiments of the present invention are described herein, including the best mode known to the inventors for carrying out the invention. Of course, variations on these described embodiments will become apparent to those of ordinary skill in the art upon reading the foregoing description. The inventor expects skilled artisans to employ such variations as appropriate, and the inventors intend for the present invention to be practiced otherwise than specifically described herein. Accordingly, this invention includes all modifications and equivalents of the subject matter recited in the claims appended hereto as permitted by applicable law. Moreover, any combination of the above-described embodiments in all possible variations thereof is encompassed by the invention unless otherwise indicated herein or otherwise clearly contradicted by context.

The words, language, and terminology used in this specification is for the purpose of describing particular embodiments, elements, steps and/or limitations only and is not intended to limit the scope of the present invention, which is defined solely by the claims. In addition, such words, language, and terminology are to be understood not only in the sense of their commonly defined meanings, but to include by special definition in this specification structure, material or acts beyond the scope of the commonly defined meanings. Thus, if an element, step or limitation can be understood in the context of this specification as including more than one meaning, then its use in a claim must be understood as being generic to all possible meanings supported by the specification and by the word itself.

The definitions and meanings of the elements, steps or limitations recited in a claim set forth below are, therefore, defined in this specification to include not only the combination of elements, steps or limitations which are literally set forth, but all equivalent structure, material or acts for performing substantially the same function in substantially the same way to obtain substantially the same result. In this sense it is therefore contemplated that an equivalent substitution of two or more elements, steps or limitations may be made for any one of the elements, steps or limitations in a claim set forth below or that a single element, step or limitation may be substituted for two or more elements, steps or limitations in such a claim. Although elements, steps or limitations may be described above as acting in certain combinations and even initially claimed as such, it is to be expressly understood that one or more elements, steps or limitations from a claimed combination can in some cases be excised from the combination and that the claimed combination may be directed to a sub-combination or variation of a sub-combination. As such, notwithstanding the fact that the elements, steps and/or limitations of a claim are set forth below in a certain combination, it must be expressly understood that the invention includes other combinations of fewer, more or different elements, steps and/or limitations, which are disclosed in above even when not initially claimed in such combinations. Furthermore, insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements. Accordingly, the claims are thus to be understood to include what is specifically illustrated and described above, what is conceptually equivalent, what can be obviously substituted and also what essentially incorporates the essential idea of the invention.

Unless otherwise indicated, all numbers expressing a characteristic, item, quantity, parameter, property, term, and so forth used in the present specification and claims are to be understood as being modified in all instances by the term "about." As used herein, the term "about" means that the characteristic, item, quantity, parameter, property, or term so qualified encompasses a range of plus or minus ten percent above and below the value of the stated characteristic, item, quantity, parameter, property, or term. Accordingly, unless indicated to the contrary, the numerical parameters set forth in the specification and attached claims are approximations that may vary. For instance, as mass spectrometry instruments can vary slightly in determining the mass of a given analyte, the term "about" in the context of the mass of an ion or the mass/charge ratio of an ion refers to +/−0.50 atomic mass unit. At the very least, and not as an attempt to limit the application of the doctrine of equivalents to the scope of the claims, each numerical indication should at least be construed in light of the number of reported significant digits and by applying ordinary rounding techniques.

Notwithstanding that the numerical ranges and values setting forth the broad scope of the invention are approximations, the numerical ranges and values set forth in the specific examples are reported as precisely as possible. Any numerical range or value, however, inherently contains certain errors necessarily resulting from the standard deviation found in their respective testing measurements. Recitation of numerical ranges of values herein is merely intended to serve as a shorthand method of referring individually to each separate numerical value falling within the range. Unless otherwise indicated herein, each individual value of a numerical range is incorporated into the present specification as if it were individually recited herein.

Use of the terms "may" or "can" in reference to an embodiment or aspect of an embodiment also carries with it the alternative meaning of "may not" or "cannot." As such, if the present specification discloses that an embodiment or an aspect of an embodiment may be or can be included as part of the inventive subject matter, then the negative limitation or exclusionary proviso is also explicitly meant, meaning that an embodiment or an aspect of an embodiment may not be or cannot be included as part of the inventive subject matter. In a similar manner, use of the term "optionally" in reference to an embodiment or aspect of an embodiment means that such embodiment or aspect of the embodiment may be included as part of the inventive subject matter or may not be included as part of the inventive subject matter. Whether such a negative limitation or exclusionary proviso applies will be based on whether the negative limitation or exclusionary proviso is recited in the claimed subject matter.

The terms "a," "an," "the" and similar references used in the context of describing the present invention (especially in the context of the following claims) are to be construed to cover both the singular and the plural, unless otherwise indicated herein or clearly contradicted by context. Further, ordinal indicators—such as, e.g., "first," "second," "third," etc.—for identified elements are used to distinguish between the elements, and do not indicate or imply a required or limited number of such elements, and do not indicate a particular position or order of such elements unless otherwise specifically stated. All methods described herein can be performed in any suitable order unless otherwise indicated herein or otherwise clearly contradicted by context. The use of any and all examples or exemplary language (e.g., "such as") provided herein is intended merely to better illuminate the present invention and does not pose a limitation on the scope of the invention otherwise claimed. No language in the present specification should be construed as indicating any non-claimed element essential to the practice of the invention.

When used in the claims, whether as filed or added per amendment, the open-ended transitional term "comprising", variations thereof such as, e.g., "comprise" and "comprises", and equivalent open-ended transitional phrases thereof like "including," "containing" and "having", encompass all the expressly recited elements, limitations, steps, integers, and/or features alone or in combination with unrecited subject matter; the named elements, limitations, steps, integers, and/or features are essential, but other unnamed elements, limitations, steps, integers, and/or features may be added and still form a construct within the scope of the claim. Specific embodiments disclosed herein may be further limited in the claims using the closed-ended transitional phrases "consisting of" or "consisting essentially of" (or variations thereof such as, e.g., "consist of", "consists of", "consist essentially of", and "consists essentially of") in lieu of or as an amendment for "comprising." When used in the claims, whether as filed or added per amendment, the closed-ended transitional phrase "consisting of" excludes any element, limitation, step, integer, or feature not expressly recited in the claims. The closed-ended transitional phrase "consisting essentially of" limits the scope of a claim to the expressly recited elements, limitations, steps, integers, and/or features and any other elements, limitations, steps, integers, and/or features that do not materially affect the basic and novel characteristic(s) of the claimed subject matter. Thus, the meaning of the open-ended transitional phrase "comprising" is being defined as encompassing all the specifically recited elements, limitations, steps and/or features as well as any optional, additional unspecified ones. The meaning of the closed-ended transitional phrase "consisting of" is being defined as only including those elements, limitations, steps, integers, and/or features specifically recited in the claim, whereas the meaning of the closed-ended transitional phrase "consisting essentially of" is being defined as only including those elements, limitations, steps, integers, and/or features specifically recited in the claim and those elements, limitations, steps, integers, and/or features that do not materially affect the basic and novel characteristic(s) of the claimed subject matter. Therefore, the open-ended transitional phrase "comprising" (and equivalent open-ended transitional phrases thereof) includes within its meaning, as a limiting case, claimed subject matter specified by the closed-ended transitional phrases "consisting of" or "consisting essentially of." As such, the embodiments described herein or so claimed with the phrase "comprising" expressly and unambiguously provide description, enablement, and support for the phrases "consisting essentially of" and "consisting of."

Lastly, all patents, patent publications, and other references cited and identified in the present specification are individually and expressly incorporated herein by reference in their entirety for the purpose of describing and disclosing, for example, the compositions and methodologies described in such publications that might be used in connection with the present invention. These publications are provided solely for their disclosure prior to the filing date of the present application. Nothing in this regard is or should be construed as an admission that the inventors are not entitled to antedate such disclosure by virtue of prior invention or for any other reason. All statements as to the date or representation as to the contents of these documents are based on the information available to the applicant and do not constitute any admission as to the correctness of the dates or contents of these documents.

The invention claimed is:

1. An anchored hole cover for covering a bore hole formed through a paved surface, the anchored hole cover comprising:

a cover plate having a top surface and a bottom surface opposite the top surface, the top surface being configured to support safe passage of pedestrians and vehicular traffic across the anchored hole cover;

an anchoring mechanism having an actuator tool engagement portion mechanically connected to a bore hole engagement portion through a linkage system, the anchoring mechanism being coupled with the cover plate and extending from the bottom surface of the cover plate; and a linkage biasing mechanism having a spring element that biases the linkage system radially outward when the spring element is deflected, and a housing configured to receive therethrough a drive screw with a drive trunnion threadably coupled thereon, the spring element and a drive trunnion being captured within the housing, the housing prohibits rotational movement of the drive trunnion and permits axial movement of the drive trunnion along the drive screw within the housing as the drive screw is rotated, the spring element being compressed by the drive trunnion during the first movement through the linkage system;

wherein, during an insertion procedure, the anchoring mechanism is configured to be positioned within the bore hole and supported at least initially therein by the cover plate that is configured to rest upon the paved surface and substantially cover the bore hole;

and wherein, during a fastening procedure, the actuator tool engagement portion of the anchoring mechanism is configured to be actuated to cause a first movement through the linkage system to move the bore hole engagement portion into anchoring contact with the bore hole and to deflect the spring element to substantially prevent extraction of the anchoring mechanism from the bore hole and to substantially prevent lifting of the cover plate due to forces exerted by vehicular traffic thereupon.

2. The anchored hole cover of claim 1, wherein, during an unfastening procedure, the actuator tool engagement portion of the anchoring mechanism is configured to be actuated to cause a second movement through the linkage system to pull the bore hole engagement portion out of anchoring contact with the bore hole and to release the spring element to permit extraction of the anchoring mechanism from the bore hole.

3. The anchored hole cover of claim 2, wherein actuation comprises rotation of the actuator tool engagement portion in a first rotational direction to cause the first movement and rotation of the actuator tool engagement portion in a second rotational direction opposite the first rotational direction to cause the second movement.

4. The anchored hole cover of claim 1, wherein the cover plate further comprises an actuator tool access opening, the actuator tool engagement portion being situated substantially flush or below the top surface of the cover plate and sufficiently aligned with the actuator tool access opening to permit actuation of the actuator tool engagement portion through the actuator tool access opening.

5. The anchored hole cover of claim 1, wherein the linkage biasing mechanism further comprises a drive trunnion plate through which the drive screw passes, the spring element being compressed between the drive trunnion and the drive trunnion plate.

6. The anchored hole cover of claim 5, wherein the linkage system of the anchoring mechanism is a scissor linkage, the drive screw is coupled to and extends downward through a clearance hole formed through a trunnion plate of an anchoring mechanism support bracket extending from the bottom surface of the top plate, wherein rotation of the head of the drive screw in a first rotational direction causes the drive trunnion to move toward the trunnion plate to move the bore hole engagement portion into anchoring contact with the bore hole.

7. The anchored hole cover of claim 6, wherein the scissor linkage further comprises:

a first upper arm pivotally coupled to the trunnion plate by a first upper arm upper end and a first lower arm pivotally coupled by a first lower arm upper end to a first upper arm lower end to form the bore hole engagement portion, a first lower arm lower end being pivotally coupled to the trunnion plate; and a second upper arm pivotally coupled to the trunnion plate by a second upper arm upper end and a second lower arm pivotally coupled by a second lower arm upper end to a second upper arm lower end to form the second bore hole engagement portion, a second lower arm lower end being pivotally coupled to the trunnion plate.

8. The anchored hole cover of claim 7, wherein the scissor linkage further comprises:

a third upper arm pivotally coupled to the trunnion plate by a third upper arm upper end and a third lower arm pivotally coupled by a third lower arm upper end to a third upper arm lower end to form the third bore hole engagement portion, a third lower arm lower end being pivotally coupled to the trunnion plate.

9. The anchored hole cover of claim 7, wherein the first upper arm and the first lower arm are nestable, and the second upper arm and the second lower arm are nestable.

10. The anchored hole cover of claim 1, further comprising:

an anchoring mechanism support bracket extending from the bottom surface of the top plate, the anchoring mechanism support bracket having a trunnion plate with a clearance hole formed therethrough, an interior space of the anchoring mechanism support bracket being defined at least partially between the bottom surface of the top plate and the trunnion plate; and a drive screw coupled to and extending downward through the clearance hole of the trunnion plate, the actuator tool engagement portion is the head of the drive screw, the drive screw being supported such that the head is positioned within the interior space and such that the drive screw is permitted to rotate about a longitudinal axis thereof.

11. The anchored hole cover of claim 10, wherein the drive screw includes a retaining groove proximal to the head where the retaining groove is positioned within the interior space and receives therein a retaining ring rotatably supporting the drive screw extending therebelow.

12. The anchored hole cover of claim 10, wherein a stop at the distal end of the drive screw limits the axial travel of the linkage biasing system.

13. The anchored hole cover of claim 1, wherein the linkage biasing system biases the linkage system such that anchoring contact with the bore hole is maintained by the bore hole engagement portion.

14. An anchored hole cover for covering a bore hole formed through a paved surface, the anchored hole cover comprising:

a cover plate having a top surface and a bottom surface opposite the top surface, the top surface being configured to support safe passage of pedestrians and vehicular traffic across the anchored hole cover;

an anchoring mechanism having an actuator tool engagement portion mechanically connected to a bore hole engagement portion through a linkage system with a drive screw, the anchoring mechanism being coupled with the cover plate and extending from the bottom surface of the cover plate; and a linkage biasing mechanism having a housing receiving therethrough the drive screw with a drive trunnion threadably coupled thereon, a spring element and drive trunnion being captured within the housing, the housing prohibiting rotational movement and permitting axial movement of the drive trunnion along the drive screw within the housing as the drive screw is rotated, the spring element being compressed by the drive trunnion during a first movement through the linkage system to bias the bore hole engagement portion radially outward;

wherein, during an insertion procedure, the anchoring mechanism is configured to be positioned within the bore hole and supported at least initially therein by the cover plate that is configured to rest upon the paved surface and substantially cover the bore hole;

and wherein, during a fastening procedure, the actuator tool engagement portion of the anchoring mechanism is configured to be actuated to cause the first movement through the linkage system to move the bore hole engagement portion into anchoring contact with the bore hole and to deflect the spring element to substantially prevent extraction of the anchoring mechanism from the bore hole and to substantially prevent lifting of the cover plate due to forces exerted by vehicular traffic thereupon.

15. The anchored hole cover of claim 14, wherein the linkage system of the anchoring mechanism is a scissor linkage, the drive screw is coupled to and extends downward through a clearance hole formed through a trunnion plate of an anchoring mechanism support bracket extending from the bottom surface of the top plate, wherein rotation of the drive screw in a first rotational direction causes the drive trunnion to move toward the trunnion plate to move the bore hole engagement portion into anchoring contact with the bore hole.

16. The anchored hole cover of claim 15, wherein the scissor linkage further comprises:

a first upper arm pivotally coupled to the trunnion plate by a first upper arm upper end and a first lower arm pivotally coupled by a first lower arm upper end to a first upper arm lower end to form the bore hole engagement portion, a first lower arm lower end being pivotally coupled to the trunnion plate; and a second upper arm pivotally coupled to the trunnion plate by a second upper arm upper end and a second lower arm pivotally coupled by a second lower arm upper end to a second upper arm lower end to form the second bore hole engagement portion, a second lower arm lower end being pivotally coupled to the trunnion plate.

17. The anchored hole cover of claim 16, wherein the scissor linkage further comprises:

a third upper arm pivotally coupled to the trunnion plate by a third upper arm upper end and a third lower arm pivotally coupled by a third lower arm upper end to a third upper arm lower end to form the third bore hole engagement portion, a third lower arm lower end being pivotally coupled to the trunnion plate.

18. The anchored hole cover of claim 14, further comprising:

an anchoring mechanism support bracket extending from the bottom surface of the top plate, the anchoring mechanism support bracket having a trunnion plate with a clearance hole formed therethrough, an interior space of the anchoring mechanism support bracket being defined at least partially between the bottom surface of the top plate and the trunnion plate; and the drive screw being coupled to and extending downward through the clearance hole of the trunnion plate, the actuator tool engagement portion is a head of the drive screw, the drive screw being supported such that the head is positioned within the interior space and such that the drive screw is permitted to rotate about a longitudinal axis thereof.

19. The anchored hole cover of claim 18, wherein the drive screw includes a retaining groove proximal to the head where the retaining groove is positioned within the interior space and receives therein a retaining ring rotatably supporting the drive screw extending therebelow.

20. An anchored hole cover for covering a bore hole formed through a paved surface, the anchored hole cover comprising:

a cover plate having a top surface and a bottom surface opposite the top surface, the top surface being configured to support safe passage of pedestrians and vehicular traffic across the anchored hole cover;

an anchoring mechanism having an actuator tool engagement portion mechanically connected to a bore hole engagement portion through a linkage system, the anchoring mechanism being coupled with the cover plate and extending from the bottom surface of the cover plate; and a linkage biasing mechanism having a spring element that biases the linkage system radially outward when the spring element is deflected;

wherein during an insertion procedure, the anchoring mechanism is configured to be positioned within the bore hole and supported at least initially therein by the cover plate that is configured to rest upon the paved surface and substantially cover the bore hole; and wherein during a fastening procedure, the actuator tool engagement portion of the anchoring mechanism is configured to be actuated to cause a first movement through the linkage system to move the bore hole engagement portion into anchoring contact with the bore hole and to deflect the spring element to substantially prevent extraction of the anchoring mechanism from the bore hole and to substantially prevent lifting of the cover plate due to forces exerted by vehicular traffic thereupon;

wherein during an unfastening procedure, the actuator tool engagement portion of the anchoring mechanism is configured to be actuated to cause a second movement through the linkage system to pull the bore hole engagement portion out of anchoring contact with the bore hole and to release the spring element to permit extraction of the anchoring mechanism from the bore hole; and wherein actuation comprises rotation of the actuator tool engagement portion in a first rotational direction to cause the first movement and rotation of the actuator tool engagement portion in a second rotational direction opposite the first rotational direction to cause the second movement.

* * * * *